US011592774B2

(12) United States Patent
Maeda

(10) Patent No.: US 11,592,774 B2
(45) Date of Patent: Feb. 28, 2023

(54) IMAGE FORMING APPARATUS AND IMAGE FORMING METHOD

(71) Applicant: Katsuhiko Maeda, Kanagawa (JP)

(72) Inventor: Katsuhiko Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/545,463

(22) Filed: Dec. 8, 2021

(65) Prior Publication Data

US 2022/0187753 A1 Jun. 16, 2022

(30) Foreign Application Priority Data

Dec. 14, 2020 (JP) ..... JP2020-207074
Oct. 12, 2021 (JP) ..... JP2021-167634

(51) Int. Cl.
*G03G 15/00* (2006.01)
*G03G 15/16* (2006.01)

(52) U.S. Cl.
CPC ..... *G03G 15/55* (2013.01); *G03G 15/1605* (2013.01); *G03G 15/1615* (2013.01); *G03G 15/5058* (2013.01)

(58) Field of Classification Search
CPC ..... G03G 15/1615; G03G 15/5054; G03G 15/5058; G03G 15/55; G03G 2215/00059
See application file for complete search history.

(56) References Cited

U.S. PATENT DOCUMENTS

2003/0052958 A1* 3/2003 Shinohara ..... G03G 15/0194 347/116
2004/0070661 A1 4/2004 Maeda
2005/0031361 A1* 2/2005 Kobayashi ..... G03G 15/01 399/49
2006/0165442 A1* 7/2006 Kobayashi ..... G03G 15/1685 399/301
2007/0217831 A1 9/2007 Maeda
2008/0013972 A1* 1/2008 Matsuda ..... G03G 15/0131 399/45

(Continued)

FOREIGN PATENT DOCUMENTS

JP 2007-293047 11/2007
JP 2020003683 A * 1/2020 ..... H04N 5/335

OTHER PUBLICATIONS

Machine translation of JP 2020-003683. Jan. 2020. (Year: 2020).*

*Primary Examiner* — Carla J Therrien
(74) *Attorney, Agent, or Firm* — Duft & Bornsen, PC

(57) ABSTRACT

An image forming apparatus includes a transfer belt, a forming unit, a detection unit, a correction unit, a drive system, a determination unit, and a notification unit. The forming unit forms an image-misregistration detection pattern of a plurality of colors on the belt. The correction unit corrects an image misregistration of an image of each color based on a detection result of the pattern. The determination unit detects a difference amount between a pattern interval of the pattern on the belt and a pattern interval serving as a reference value for each color and determines that an abnormality has occurred in a driving state of the drive system, in response to the difference amount equal to or greater than a threshold value. The notification unit notifies occurrence of the misregistration when the determination unit determines that the driving state is abnormal, based on the difference amount of any one color.

20 Claims, 18 Drawing Sheets

(56) References Cited

U.S. PATENT DOCUMENTS

| | | | | |
|---|---|---|---|---|
| 2011/0013919 | A1* | 1/2011 | Matsuda | G03G 15/1615 399/167 |
| 2012/0163880 | A1* | 6/2012 | Kuroki | G03G 15/5058 399/301 |
| 2017/0329263 | A1* | 11/2017 | Sugiura | G03G 15/1675 |
| 2021/0063909 | A1 | 3/2021 | Maeda | |

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. § 119(a) to Japanese Patent Application Nos. 2020-207074, filed on Dec. 14, 2020, and 2021-167634, filed on Oct. 12, 2021, in the Japan Patent Office, the entire disclosure of each of which is incorporated by reference herein.

BACKGROUND

Technical Field

Embodiments of the present disclosure relate to an image forming apparatus and an image forming method.

Related Art

Color image forming apparatuses are known that irradiates an image bearer with image light corresponding to image data to form a latent image, develops the latent image into a visible image in a developing unit, and transfers the visible image onto a recording sheet of paper to form the image on the recording medium.

In such a color image forming apparatus, there is known a technique of detecting an image-misregistration detection pattern transferred onto a belt, calculating an image misregistration amount of each color with respect to a reference color, and correcting an image position according to the calculation result.

SUMMARY

According to an embodiment of the present disclosure, there is provided an image forming apparatus that includes a transfer belt, a forming unit, a detection unit, a correction unit, a drive system, a determination unit, and a notification unit. The forming unit forms an image-misregistration detection pattern of a plurality of colors on the transfer belt. The detection unit detects the image-misregistration detection pattern formed on the transfer belt. The correction unit corrects an image misregistration of an image of each of the plurality of colors based on a detection result of the image-misregistration detection pattern by the detection unit. The drive system drives at least the transfer belt. The determination unit detects a difference amount between a pattern interval of the image-misregistration detection pattern formed on the transfer belt and a pattern interval serving as a reference value for each color, and determine that an abnormality has occurred in a driving state of the drive system, in response to the difference amount being equal to or greater than a predetermined threshold value. The notification unit notifies occurrence of the image misregistration when the determination unit determines that the driving state of the drive system is abnormal, based on the difference amount of any one of the plurality of colors.

According to another embodiment of the present disclosure, there is provided an image forming method that forming an image-misregistration detection pattern of a plurality of colors on a transfer belt; detecting the image-misregistration detection pattern formed on the transfer belt; correcting an image misregistration of an image of each of the plurality of colors based on a detection result of the image-misregistration detection pattern by the detecting; detecting a difference amount between a pattern interval of the image-misregistration detection pattern formed on the transfer belt and a pattern interval serving as a reference value for each color; determining that an abnormality has occurred in a driving state of a drive system that drives at least the transfer belt, in response to the difference amount being equal to or greater than a predetermined threshold value; and notifying occurrence of the image misregistration in response to a determination that the driving state of the drive system is abnormal, based on the difference amount of any one of the plurality of colors.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
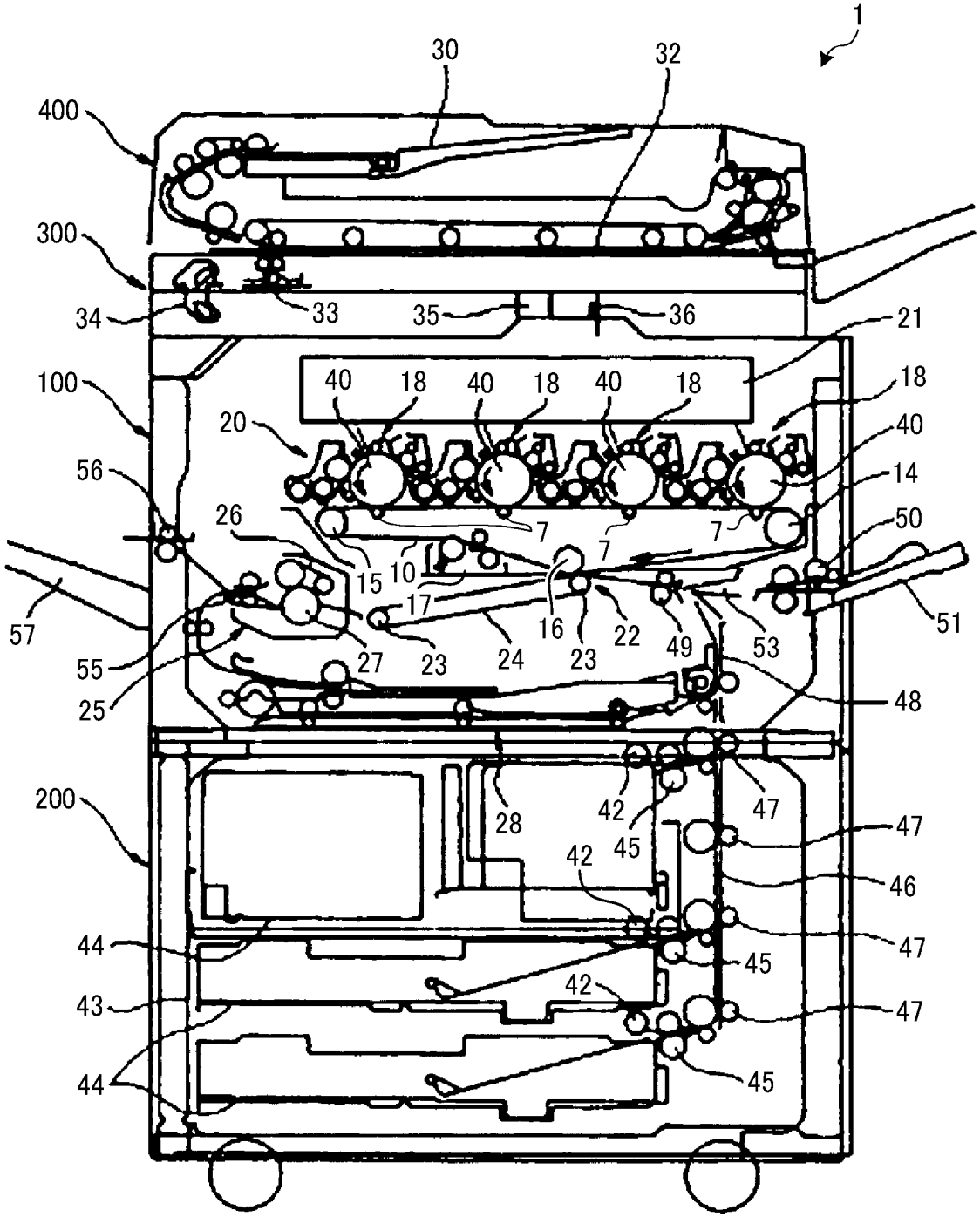
FIG. 1 is a cross-sectional view of a color image forming apparatus 1 according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a color image forming apparatus (an example of an image forming apparatus) according to an embodiment is described with reference to the accompanying drawings.

First Embodiment

Overall Configuration

FIG. 1 is a cross-sectional view of a color image forming apparatus 1 according to a first embodiment. As illustrated in FIG. 1, the color image forming apparatus 1 includes an intermediate transfer unit in a middle of the color image forming apparatus 1. The intermediate transfer unit includes an intermediate transfer belt 10 that is an endless belt. The intermediate transfer belt 10 is wound around three support rollers 14, 15, and 16 that are rotated by, for example, a motor, and is driven to rotate clockwise in FIG. 1. An intermediate-transfer-member cleaning unit 17 that removes residual toner remaining on the intermediate transfer belt 10 after image transfer is disposed on the right side of the second support roller 15 in FIG. 1.

An image forming device 20 including photoconductors 40 of yellow (Y), magenta (M), cyan (C), and black (K), chargers 18, developing units 8, and cleaning units 9 is disposed along a moving direction of the intermediate transfer belt 10 between the first support roller 14 and the second support roller 15. The image forming device 20, which is an example of a toner developing device, is attachable to and detachable from a body of the color image forming apparatus 1. A toner bottle of toner to be supplied to the developing unit 8 is provided for each color.

A light-beam scanning device 21, which is an example of an optical writing unit, is disposed above the image forming device 20. The light-beam scanning device 21 irradiates each of the photoconductors 40 of photoconductor units for the different colors with a laser beam for image formation. A secondary transfer unit 22 is disposed below the intermediate transfer belt 10. The secondary transfer unit 22 is disposed such that a secondary transfer belt 24, which is an endless belt, is stretched between two rollers 23 and the intermediate transfer belt 10 is pushed up and pressed against the third support roller 16. The secondary transfer belt 24 transfers an image on the intermediate transfer belt 10 onto a sheet P.

A fixing unit 25 that fixes the transferred image on the sheet P is disposed beside the secondary transfer unit 22. The sheet P onto which the toner image has been transferred is conveyed to the fixing unit 25. In the fixing unit 25, a heating pressure roller 27 is pressed against a fixing belt 26 that is an endless belt. A sheet reversing unit 28 is disposed below the secondary transfer unit 22 and the fixing unit 25. The sheet reversing unit 28 reverses a sheet P immediately after an image is formed on a front side of the sheet P, and conveys the sheet P to record an image on a back side of the sheet P.

When a document is set on a document feeding table 30 of an automatic document feeder (ADF) 400 and a start switch of an operation unit is operated, the document is conveyed onto an exposure glass 32. When a document is not set on the ADF 400, a scanner of an image reading unit 300 is driven to read the document manually placed on the exposure glass 32, and a first carriage 33 and a second carriage 34 are driven to perform scanning for reading. The exposure glass is irradiated with light from the light source on the first carriage 33, and the light reflected from the document surface is reflected by the first mirror on the first carriage 33 toward the second carriage 34, is reflected by the mirror on the second carriage 34, and is imaged on a charge-coupled device (CCD) 36 serving as a reading sensor through an imaging lens 35. Recording signals of Y, M, C, and K are generated based on the image signals obtained in the CCD 36.

When a start switch is operated, when image output is instructed from, for example, a personal computer device, or when the output of an image received by facsimile communication is instructed, the rotation driving of the intermediate transfer belt 10 is started, and the preparation for image formation is started in each unit of the image forming device 20. Then, an image forming sequence of each color image is started, an exposure laser modulated based on recording data for each color is projected onto the photoconductor drum for each color. Thus, toner images of the Y, M, C, and K colors are superimposed one on another and transferred on the intermediate transfer belt 10 by the image forming processes for the Y, M, C, and K colors to form a single toner image on the intermediate transfer belt 10.

A sheet P is conveyed to the secondary transfer unit 22 at a timing such that the leading end of the sheet P enters the secondary transfer unit 22 at the same time as when the leading end of the toner image enters the secondary transfer unit 22. Thus, the toner image on the intermediate transfer belt 10 is transferred to the sheet P. The sheet P onto which the toner image has been transferred is conveyed to the fixing unit 25. Thus, the toner image is fixed onto the sheet P in the fixing unit 25.

As one of sheet feed rollers 42 of a sheet feed table 200 is selectively rotated, sheets P are fed out from one of sheet feed trays 44 disposed in multiple stages in a sheet feed unit 43. The sheets P are separated one by one by a separation roller 45 and conveyed to a conveyance roller unit 46. The sheet P is conveyed to a conveyance roller unit 48 in a printer 100 by conveyance rollers 47 and is temporarily stopped by coming into contact with registration rollers 49 of the conveyance roller unit 48. Then, the sheet P is conveyed to the secondary transfer unit 22 at the timing described above.

Sheets P are insertable onto a bypass tray 51 for feeding. When a user inserts sheets P onto the bypass tray 51, the printer 100 rotates a sheet feed roller 50 to separate one of the sheets P on a bypass tray 51 and draws the separated sheet into the bypass path 53. As described above, the sheet P that has been drawn into the bypass path 53 contacts the registration rollers 49 and is temporarily stopped.

A sheet P to be ejected after the fixing process in the fixing unit 25 is guided to an ejection roller 56 by a switching claw 55 and stacked on a sheet ejection tray 57. Alternatively, the sheet P is guided to the sheet reversing unit 28 by the switching claw 55 and reversed in the sheet reversing unit 28. The sheet P is further guided to a transfer position again, and an image is recorded on the back side of the sheet P. Then, the sheet P is ejected onto the sheet ejection tray 57 by the ejection roller 56.

On the other hand, the intermediate-transfer-member cleaning unit 17 removes residual toner from the intermediate transfer belt 10 after image transfer. Thus, the color image forming apparatus 1 is ready for the next image formation.

Configuration of Image Forming Device

Figure 2:
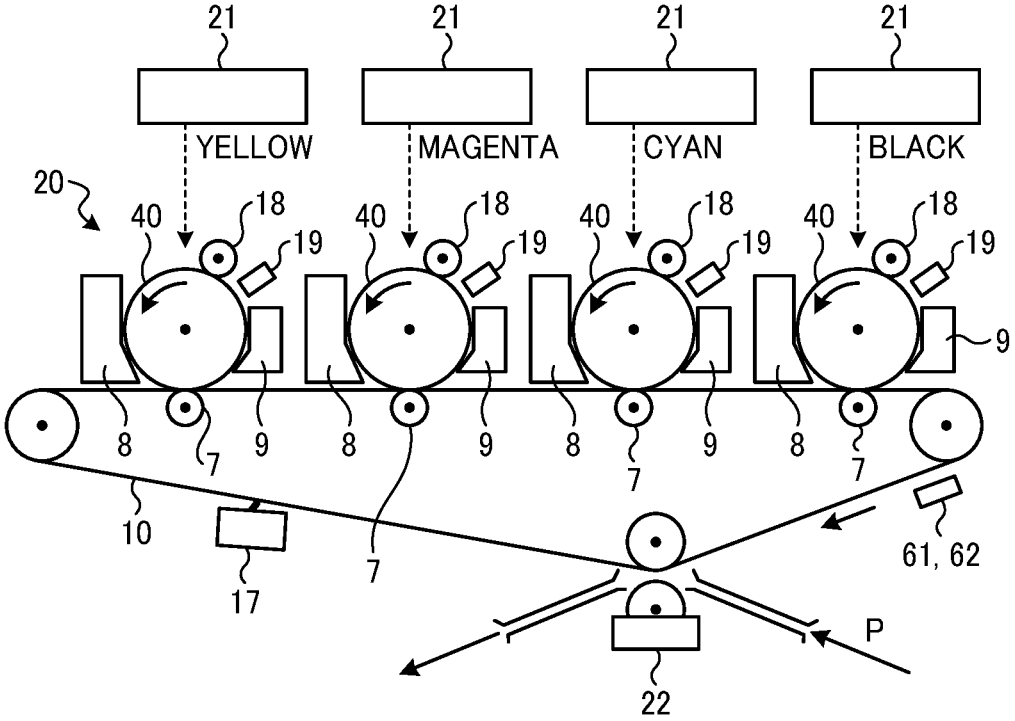
FIG. 2 is a diagram illustrating a configuration of an image forming device of a color image forming apparatus according to an embodiment of the present disclosure.

FIG. 2 is a diagram illustrating a configuration of the image forming device 20. As illustrated in FIG. 2, the image forming device 20 includes four sets of image forming units and four sets of light-beam scanning devices 21 to form color images in which images of four colors of yellow, magenta, cyan, and black are superimposed. Each photoconductor 40 is driven to rotate by, for example, a motor.

As will be described later with reference to FIG. 3, the light-beam scanning device 21 includes a laser diode (LD) control board that is driven and modulated in accordance with image data to selectively emit a light beam. The emitted light beam is deflected by a polygon mirror rotated by a polygon motor and reflected by a folding mirror via an fθ lens. Thus, the photoconductor 40, which is driven to rotate, is scanned with the reflected light beam.

For each color, a charger 18, a developing unit 8, a transfer unit 7, a cleaning unit 9, and a static eliminator 19 are disposed around the photoconductor 40. An image of a first color is formed on the intermediate transfer belt 10 by charging, exposing, developing, and transferring, which are common electrophotographic processes, and then images of a second color, a third color, and a fourth color are transferred in this order to form a color image in which the images of the four colors are superimposed. Further, the secondary transfer unit 22 transfers the color image formed on the intermediate transfer belt 10 onto the conveyed sheet P. Thus, the color image in which the images of four colors are superimposed can be formed on the sheet P. The color image formed on the sheet P is fixed on the sheet P by the fixing unit 25. Residual toner on the intermediate transfer belt 10 is removed by the intermediate-transfer-member cleaning unit 17.

As is described later, the image forming device 20 is provided with a first sensor 61 and a second sensor 62 that detect an image-misregistration detection pattern formed on the intermediate transfer belt 10. The first sensor 61 and the second sensor 62 are reflection-type optical sensors and detect image-misregistration detection patterns formed on the intermediate transfer belt 10. The color image forming apparatus 1 according to the first embodiment corrects the misregistration of an image in each of a main scanning direction and a sub-scanning direction between the colors and the magnification of the image in the main scanning direction, based on detection results of the image-misregistration detection patterns by the first sensor 61 and the second sensor 62. The color image forming apparatus 1 detects speed variations of a drive system 60 (see FIG. 4) for, for example, the photoconductor 40 and the intermediate transfer belt 10 from the detection results. Here, the drive system 60 includes members that drive, for example, the photoconductor 40, the intermediate transfer belt 10 to rotate. Examples of the members include three support rollers 14, 15, and 16 that drive the intermediate transfer belt 10 to rotate, a motor that drives the support rollers 14, 15, and 16, and a motor that drives the photoconductor 40 to rotate.

Configuration of Light-Beam Scanning Device

Figure 3:
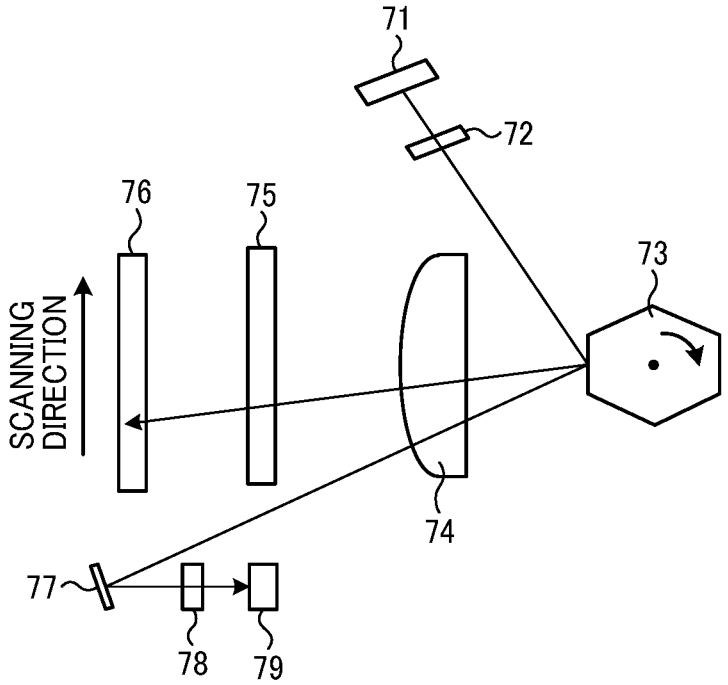
FIG. 3 is a top view of a light-beam scanning device as viewed from above.

FIG. 3 is a top view of the light-beam scanning device 21 as viewed from above. The light-beam scanning devices of the respective colors have a common configuration illustrated in FIG. 3. In FIG. 3, a light beam from a laser diode (LD) unit 71 passes through a cylinder lens (CYL) 72 and enters a polygon mirror 73. The polygon mirror 73 deflects the light beam by rotation. The deflected light beam passes through an fθ lens 74, passes through a second lens 75 that corrects, for example, the position of the light beam in the sub-scanning direction, and is irradiated onto the photoconductor 40 by a folding mirror 76. Thus, the photoconductor 40 is scanned with the light beam.

A synchronous mirror 77, a synchronous lens 78, and a synchronization sensor 79 are disposed at an end portion on the writing side in the main scanning direction. The light beam transmitted through the fθ lens 74 is reflected by the synchronous minor 77, is focused by the synchronous lens 78, and is incident on the synchronization sensor 79. The synchronization sensor 79 functions as a synchronization detection sensor for detecting a synchronization detection signal that determines a writing start timing of main scanning.

Configuration of Image Forming Controller

Figure 4:
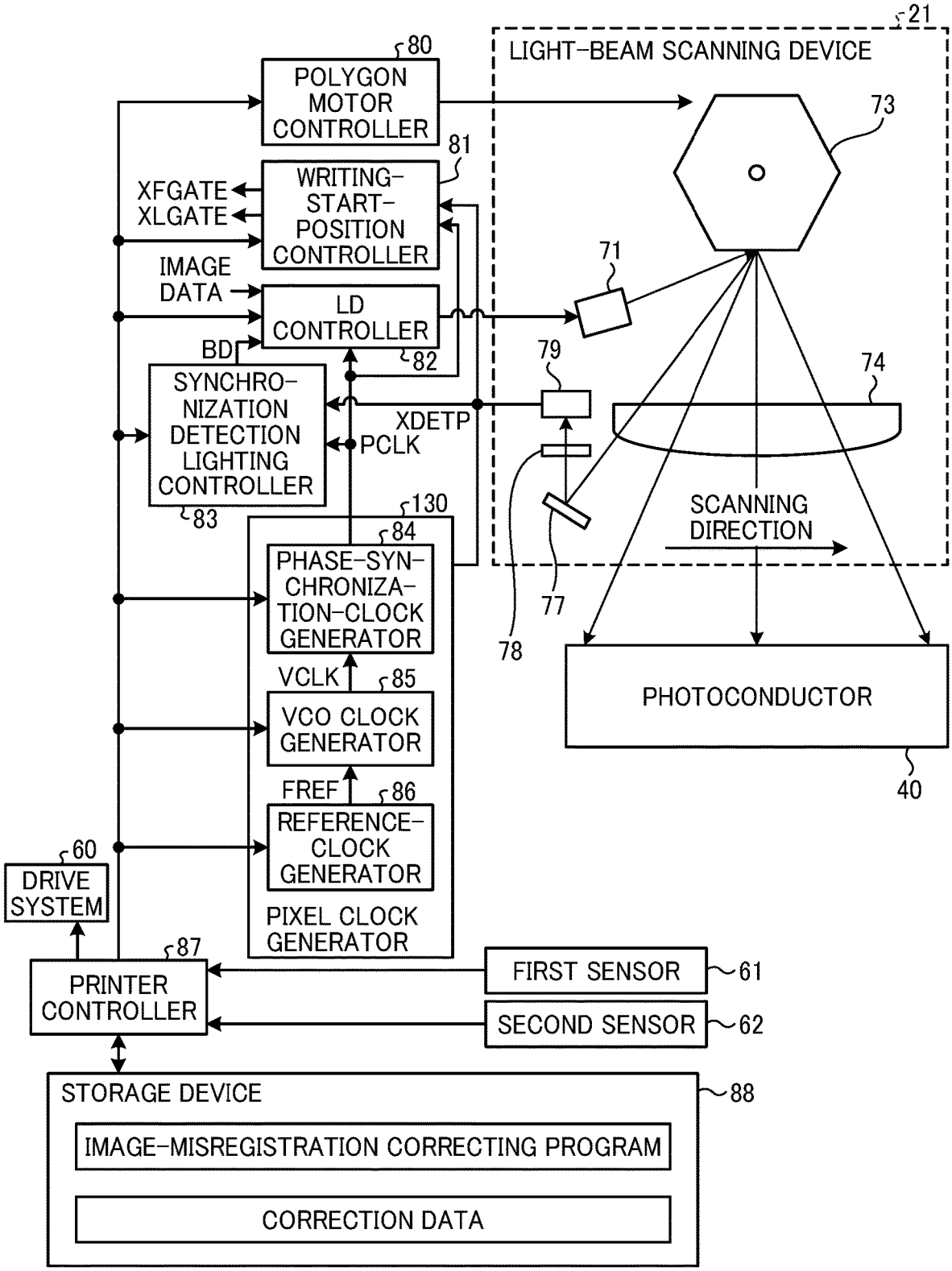
FIG. 4 is a block diagram of an image forming controller that drives the light-beam scanning device.

FIG. 4 is a block diagram of an image forming controller that drives the light-beam scanning device 21. FIG. 4 illustrates an image forming controller and a light-beam scanning device for one color. The image forming controller and the light-beam scanning device are disposed for each color, except for a printer controller 87, a storage device 88, the first sensor 61, and the second sensor 62. The printer controller 87 controls the entire color image forming apparatus 1. The printer controller 87 controls the drive system 60 to rotationally drive, for example, the photoconductor 40 and the intermediate transfer belt 10.

A synchronization sensor 79 that detects a light beam is disposed on an image writing side at an end of the light-beam scanning device 21 in the main scanning direction. The light beam transmitted through the fθ lens 74 is reflected by the synchronous minor 77, is focused by the synchronous lens 78, and is incident on the synchronization sensor 79.

When the light beam passes over the synchronization sensor 79, a synchronization detection signal XDETP is output from the synchronization sensor 79 and supplied to a phase-synchronization-clock generator 84, a synchronization detection lighting controller 83, and a writing-start-position controller 81 of a pixel clock generator 130. The phase-synchronization-clock generator 84 of the pixel clock generator 130 generates a pixel clock PCLK synchronized with the synchronization detection signal XDETP and supplies the pixel clock PCLK to the writing-start-position controller 81, the LD controller 82, and the synchronization detection lighting controller 83.

In order to first detect the synchronization detection signal XDETP, the synchronization detection lighting controller 83 turns on an LD forced lighting signal BD to forcibly light on the LD unit 71. On the other hand, after detecting the synchronization detection signal XDETP, the synchronization detection lighting controller 83 uses the synchronization detection signal XDETP and the pixel clock PCLK to control lighting of the LD unit 71 at a timing at which the synchronization detection signal XDETP can be reliably detected to the extent that flare light is not generated. Upon detecting the synchronization detection signal XDETP, the synchronization detection lighting controller 83 generates an LD forced lighting signal BD for controlling the LD unit 71 to be turned off and supplies the LD forced lighting signal BD to the LD controller 82.

The synchronization detection lighting controller 83 generates a light-amount control timing signal APC of each LD using the synchronization detection signal XDETP and the pixel clock PCLK and supplies the light-amount control timing signal APC to the LD controller 82. The generation of the light-amount control timing signal APC is executed by controlling the light amount to a predetermined light amount at a timing outside the image writing region.

The LD controller 82 controls lighting of the LD unit 71 in accordance with the image data synchronized with the forced lighting signal BD for synchronization detection, the light-amount control timing signal APC, and the pixel clock PCLK. The light beam emitted from the LD unit 71 is deflected by the polygon mirror 73, passes through the fθ lens 74 and the second lens 75, and is scanned on the photoconductor 40 by the folding mirror 76.

The polygon motor controller 80 controls the rotation of the polygon motor at a predetermined number of rotations in response to a control signal from the printer controller 87. The writing-start-position controller 81 generates a main-scanning control signal XLGATE and a sub-scanning control signal XFGATE for determining an image writing start timing and an image width based on the synchronization detection signal XDETP, the pixel clock PCLK, and the control signal from the printer controller 87.

The first sensor 61 and the second sensor 62 that detect image-misregistration detection patterns supply detected image pattern information to the printer controller 87. The printer controller 87 calculates a misregistration amount of each image-misregistration detection pattern and generates correction data for correcting the misregistration. The correction data is set in the writing-start-position controller 81 and the pixel clock generator 130 and stored in the storage device 88. When an image forming operation is performed, the correction data stored in the storage device 88 is read by the printer controller 87, which is an example of a correction unit, and is set in the writing-start-position controller 81 and the pixel clock generator 130.

The printer controller 87 calculates speed fluctuations of the photoconductor 40 and the intermediate transfer belt 10 from the pattern intervals of the image-misregistration detection patterns detected by the first sensor 61 and the second sensor 62 and displays the information on, for example, an operation panel. Details of the calculation and the information will be described later.

Configuration of VCO Clock Generator

Figure 5:
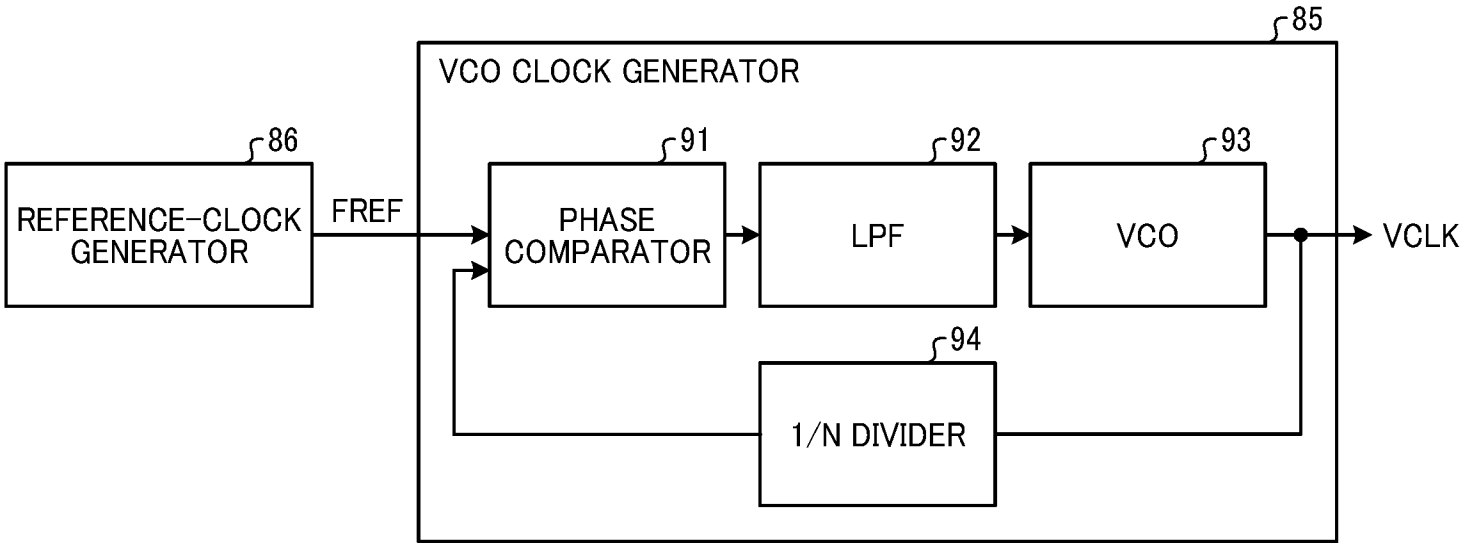
FIG. 5 is a block diagram illustrating the configuration of a voltage-controlled oscillator (VCO) clock generator of a pixel clock generator.

FIG. 5 is a block diagram illustrating the configuration of a voltage-controlled oscillator (VCO) clock generator 85 of the pixel clock generator 130. As illustrated in FIG. 5, the VCO clock generator 85 inputs a reference clock signal FREF from a reference clock generator 86 and a signal obtained by dividing the frequency of a virtual clock (VCLK) output signal, which is an output signal of the VCO clock generator 85, into N by a 1/N frequency divider 94 to a phase comparator 91.

The phase comparator 91 performs phase comparison at the timing of the falling edges of the reference clock signal FREF and the VCLK output signal and outputs an error component signal as a constant current. Unnecessary high-frequency components and noise are removed from the error component signal by a low pass filter (LPF) 92, and the error component signal is supplied to a voltage controlled oscillator (VCO) 93.

The VCO 93 oscillates oscillation frequency signals depending on the output of the LPF 92. Therefore, the printer controller 87 can vary the frequency of the VCLK output signal by varying the frequency of the reference clock signal FREF from the reference clock generator 86 and the frequency division ratio "N". As the frequency of the VCLK output signal changes, the frequency of the pixel clock PCLK also changes.

Configuration of Writing-Start-Position Controller

Figure 6:
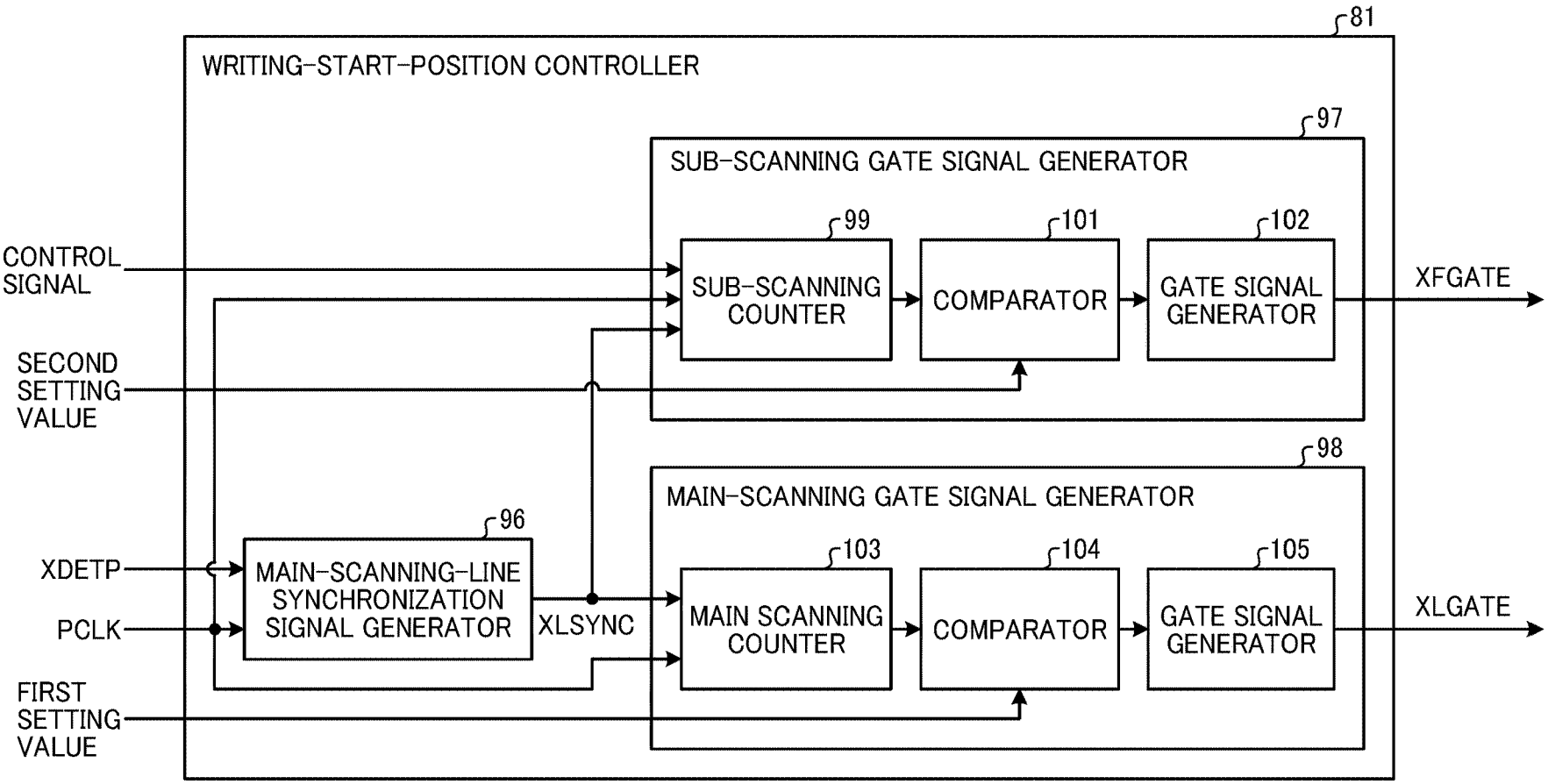
FIG. 6 is a block diagram of a writing-start-position controller.

FIG. 6 is a block diagram of the writing-start-position controller 81 illustrated in FIG. 4. As illustrated in FIG. 6, the writing-start-position controller 81 includes a main-scanning-line synchronization signal generator 96, a main-scanning gate signal generator 98, and a sub-scanning gate signal generator 97.

The main-scanning-line synchronization signal generator 96 generates an XLSYNC signal for operating a main scanning counter 103 in the main-scanning gate signal generator 98 and a sub-scanning counter 99 in the sub-scanning gate signal generator 97. The main-scanning gate signal generator 98 generates an XLGATE signal for determining the timing of capturing an image signal (timing of writing out an image in the main scanning direction). The sub-scanning gate signal generator 97 generates an XFGATE signal for determining the timing of capturing an image signal (timing of writing out an image in the sub-scanning direction).

The main-scanning gate signal generator 98 includes a comparator 104 that compares a counter value of a main scanning counter 103 that operates based on the XLSYNC signal and the pixel clock PCLK with a first set value (correction data) from the printer controller 87. The main-scanning gate signal generator 98 includes a gate signal generator 105 that generates an XLGATE signal based on a comparison result from the comparator 104.

The sub-scanning gate signal generator 97 includes a sub-scanning counter 99 and a comparator 101. The sub-scanning counter 99 operates based on the control signal (print start signal) from the printer controller 87, the XLSYNC signal, and the pixel clock PCLK. The comparator 101 compares a counter value with a second set value (correction data) from the printer controller 87. The sub-scanning gate signal generator 97 includes a gate signal generator 102 that generates an XFGATE signal based on the comparison result from the comparator 101.

Based on the correction data stored in the storage device 88, the writing-start-position controller 81 corrects the writing position in the main scanning direction in units of one cycle of the pixel clock PCLK, that is, in units of one dot of the pixel clock PCLK. Based on the correction data stored in the storage device 88, the writing-start-position controller 81 corrects the writing position in the sub-scanning direction in units of one cycle of the XLSYNC signal, that is, in units of one line of the XLSYNC signal.

Figure 7:
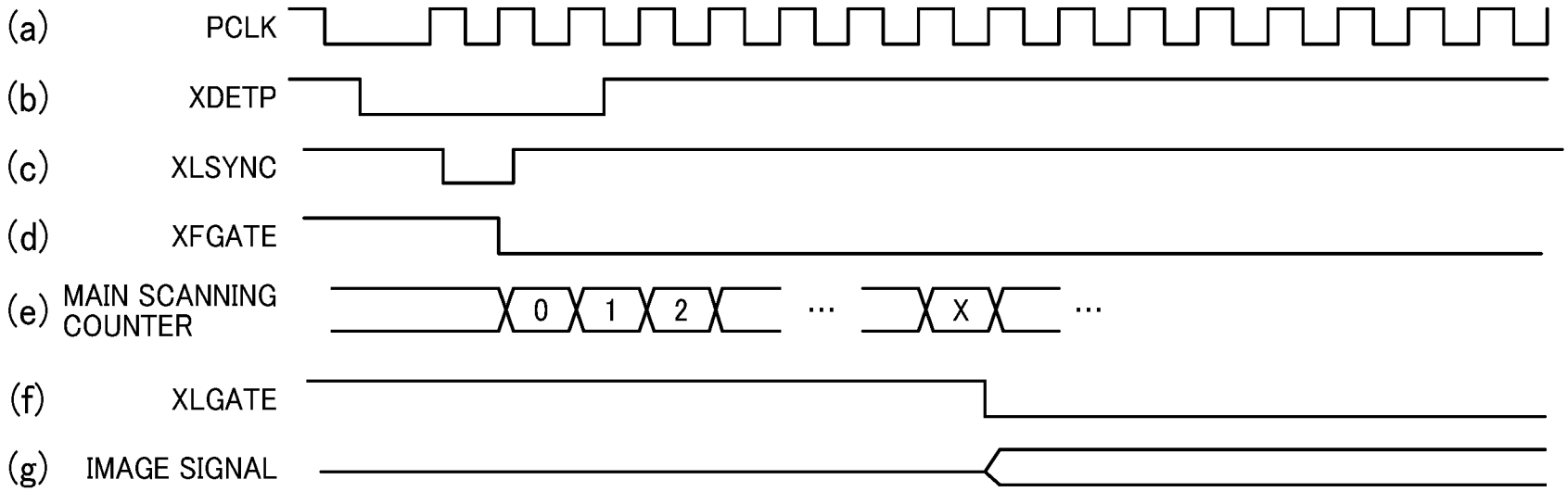
FIG. 7 is a timing chart of writing position control in a main scanning direction in the writing-start-position controller.

FIG. 7 is a timing chart of writing start position control in the main scanning direction by the writing-start-position controller 81. Part (a) of FIG. 7 illustrates the timing of the pixel clock PCLK. Part (b) of FIG. 7 illustrates the timing of the synchronization detection signal XDETP output from the synchronization sensor 79 when the light beam passes over the synchronization sensor 79. Part (c) of FIG. 7 illustrates the timing of the XLSYNC signal generated by the main-scanning-line synchronization signal generator 96. Part (d) of FIG. 7 illustrates the timing of the XFGATE signal generated by the gate signal generator 102. Part (e) of FIG. 7 illustrates the counter value of the main scanning counter 103. Part (f) of FIG. 7 illustrates the timing of the XLGATE signal generated by the gate signal generator 105. Part (g) of FIG. 7 illustrates the timing of the image signal.

In the timing chart of FIG. 7, after the counter value is reset by the XLSYNC signal illustrated in part (c) of FIG. 7, the main scanning counter 103 starts counting the pixel clock PCLK illustrated in part (a) of FIG. 7. Accordingly, each time the main scanning counter 103 counts the pixel clock PCLK, the counter value is incremented by one as illustrated in part (e) of FIG. 7. When the counter value reaches the first set value set by the printer controller 87 (in this case, the counter value of "X" illustrated in part (e) of FIG. 7), the comparator 104 outputs the comparison result. The XLGATE signal generated by the gate signal generator 105 changes to the Low level (valid) as illustrated in part (0 of FIG. 7. The XLGATE signal is a signal that changes to the Low level for the image width in the main scanning direction.

Figure 8:
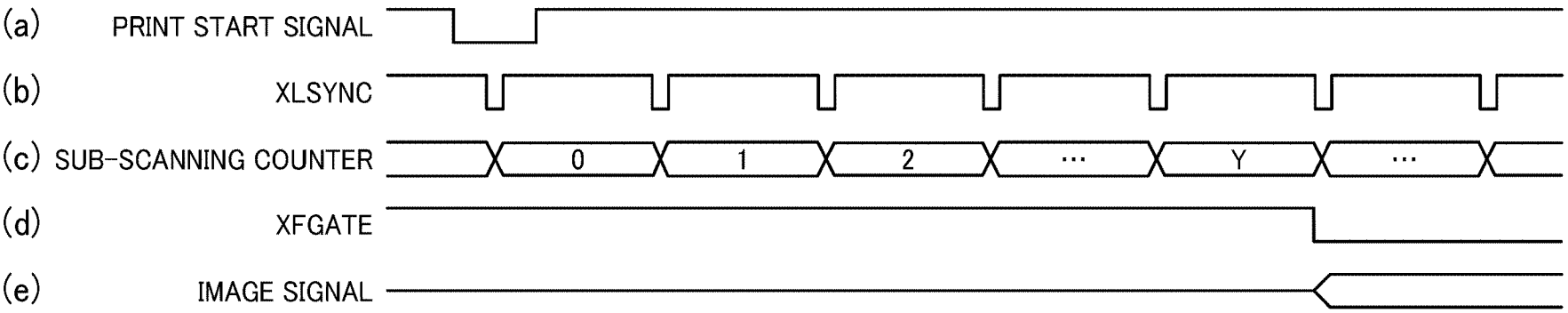
FIG. 8 is a timing chart of writing position control in a sub-scanning direction in the writing-start-position controller.

FIG. 8 is a timing chart of writing position control in the sub-scanning direction by the writing-start-position controller 81. Part (a) of FIG. 8 illustrates the timing of the print start signal. Pat (b) of FIG. 8 illustrates the timing of the XLSYNC signal generated by the main-scanning-line synchronization signal generator 96. Part (c) of FIG. 8 illustrates the counter value of the sub-scanning counter 99. Part (d) of FIG. 8 illustrates the timing of the XFGATE signal generated by the gate signal generator 102. Part (e) of FIG. 8 illustrates the timing of the image signal.

In the timing chart of FIG. 8, after the counter value of the sub-scanning counter 99 illustrated in part (c) of FIG. 8 is reset by the print start signal from the printer controller 87 illustrated in part (a) of FIG. 8, the main-scanning-line synchronization signal generator 96 starts counting the XLSYNC signal illustrated in part (b) of FIG. 8. Thus, each time the sub-scanning counter 99 counts the XLSYNC signal, the counter value is incremented by one as illustrated in part (c) of FIG. 8. When the counter value reaches the second set value set by the printer controller 87 (in this case, the counter value of "Y" illustrated in part (c) of FIG. 8), the comparator 101 outputs the comparison result. The XFGATE signal generated by the gate signal generator 102 changes to the Low level (valid) as illustrated in part (d) of FIG. 8. The XFGATE signal is a signal that changes to the Low level for the image length in the sub-scanning direction.

Configuration of LD Controller

Figure 9:
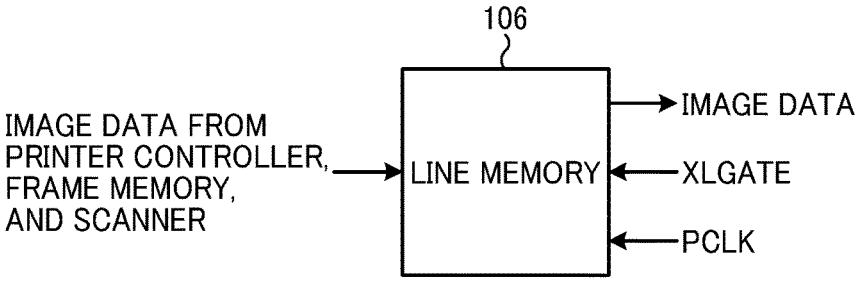
FIG. 9 is a block diagram illustrating a configuration of a preceding stage of a laser diode (LD) controller.

FIG. 9 is a block diagram illustrating a configuration of a preceding stage of the LD controller 82. As illustrated in FIG. 9, a line memory 106 is disposed in the preceding stage of the LD controller 82. The LD controller 82 uses a line memory 106 to acquire image data from, for example, a printer controller, a frame memory, or a scanner at the timing of the XFGATE signal and the XLGATE signal. The image data taken into the line memory 106 is output in synchronization with the pixel clock PCLK and supplied to the LD unit 71. Thus, a light beam is emitted from the LD unit 71.

Print Control Operation

Figure 10:
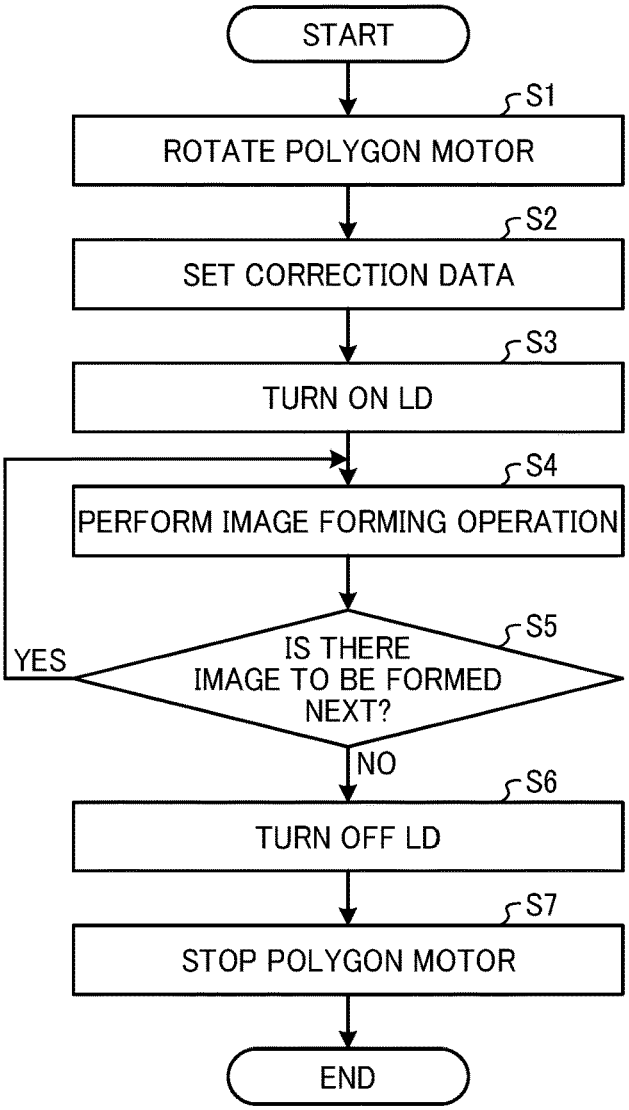
FIG. 10 is a flowchart illustrating the process of a print control operation of the color image forming apparatus according to the first embodiment.

FIG. 10 is a flowchart illustrating the process of a print control operation of the color image forming apparatus 1 according to the first embodiment. In the flowchart of FIG. 10, when the start key of the operation panel is operated, the printer controller 87 controls the polygon motor controller 80 to rotate the polygon motor at a specified rotation speed based on printing conditions (step S1).

Next, the printer controller 87 sets the correction data (the writing start positions in the main scanning direction and the sub-scanning direction, and the magnification setting values) stored in the storage device 88 to the writing-start-position controller 81, the LD controller 82, the synchronization detection lighting controller 83, and the pixel clock generator 130 (step S2). Thus, the LDs for outputting the synchronization detection signal can be turned on, and each LD can be turned on with a specified light amount (APC operation: step S3).

Thereafter, the printer controller 87 starts an image forming operation (step S4). If there is no next image (No in step S5), the printer controller 87 controls the LD controller 82 to turn off each LD (step S6). The printer controller 87 controls the polygon motor controller 80 to stop the polygon motor (step S7) and ends the print control process illustrated in the flowchart of FIG. 10.

Image Misregistration Correction Function

Here, the color image forming apparatus 1 according to the first embodiment performs an image-misregistration correction process at a predetermined timing. The printer controller 87 executes the image-misregistration correction process based on an image misregistration correction program stored in the storage device 88.

Figure 11:
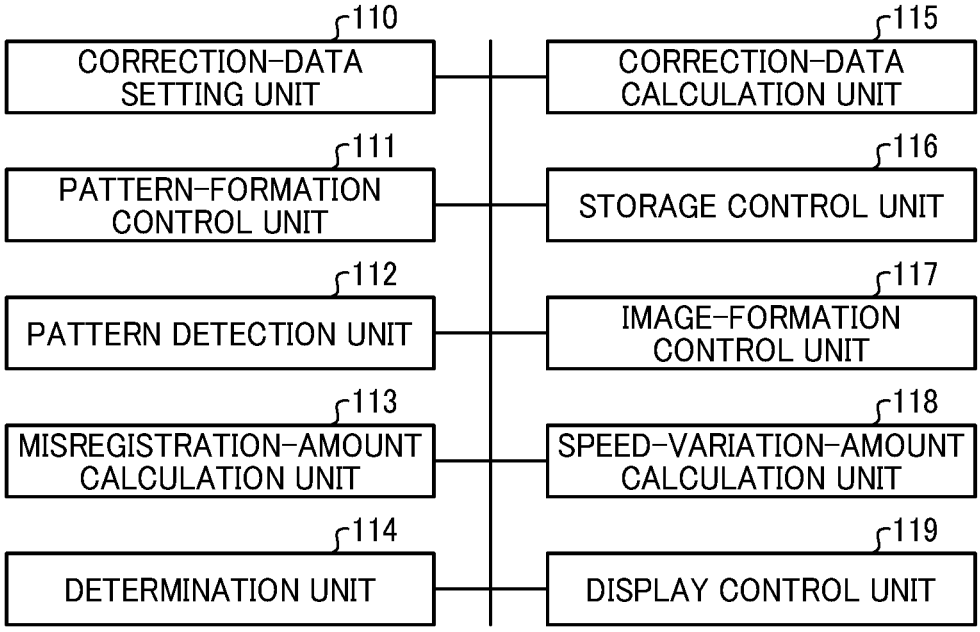
FIG. 11 is a functional block diagram illustrating functions implemented by a printer controller executing an image misregistration correction program stored in a storage device.

FIG. 11 is a functional block diagram illustrating functions implemented by the printer controller 87 executing the image misregistration correction program stored in the storage device 88. As illustrated in FIG. 11, the printer controller 87 executes the image misregistration correction program to implement functions of a correction-data setting unit 110, a pattern-formation control unit 111, a pattern detection unit 112, a misregistration-amount calculation unit 113, a determination unit 114, a correction-data calculation unit 115, a storage control unit 116, an image-formation control unit 117, a speed-variation-amount calculation unit 118, and a display control unit 119.

The correction-data setting unit 110 sets correction data stored in the storage device 88 to the writing-start-position controller 81, the LD controller 82, the synchronization detection lighting controller 83, and the pixel clock generator 130. The pattern-formation control unit 111, which is an example of a formation unit, forms an image-misregistration correction pattern. The pattern detection unit 112, which is an example of a detection unit, detects an image-misregistration correction pattern formed on the intermediate transfer belt 10 based on the sensor outputs of the first sensor 61 and the second sensor 62.

The misregistration-amount calculation unit 113 calculates a misregistration amount (color-deviation amount) of each color with respect to the reference color based on the image-misregistration correction pattern detected by the pattern detection unit 112. The determination unit 114 determines whether to perform image misregistration correction based on the calculated deviation amount of each color with respect to the reference color. The correction-data calculation unit 115 calculates the correction data when image misregistration correction is performed. The storage control unit 116 updates the correction data stored in the storage device 88 with the calculated correction data.

The image-formation control unit 117 performs the printing process described with reference to the flowchart of FIG. 10 based on the calculated correction data. The speed-variation-amount calculation unit 118 calculates a driving state (speed variation amount) of the drive system 60 such as the driving state of the photoconductor 40 and the intermediate transfer belt 10 on which the image-misregistration detection patterns are formed. When the calculated speed variation amount of the drive system 60 is equal to or greater than a predetermined value, the display control unit 119, which is an example of a notification unit, controls a display to display an error message indicating that an abnormality has occurred.

In this example, the correction-data setting unit 110, the pattern-formation control unit 111, the pattern detection unit 112, the misregistration-amount calculation unit 113, the determination unit 114, the correction-data calculation unit 115, the storage control unit 116, the image-formation control unit 117, the speed-variation-amount calculation unit 118, and the display control unit 119 are implemented by software using an image misregistration correction program. However, all or part of the above-described units may be implemented by hardware such as an integrated circuit (IC).

The image misregistration correction program may be recorded in and provided with a computer-readable recording medium such as a compact disc-read only memory (CD-ROM) or a flexible disk (FD) as file information in an installable format or an executable format. Alternatively, the image misregistration correction program may be recorded in and provided with a recording medium readable by a computer device, such as a compact disc-recordable (CD-R), a digital versatile disk (DVD), a Blu-ray (registered trademark) disk, or a semiconductor memory. Further, the image misregistration correction program may be provided in a form of being installable via a network such as the Internet. Furthermore, the image misregistration correction program may be incorporated in and provided with, for example, a read only memory (ROM) in the apparatus in advance.

Image-Misregistration Correction Process

Figure 12:
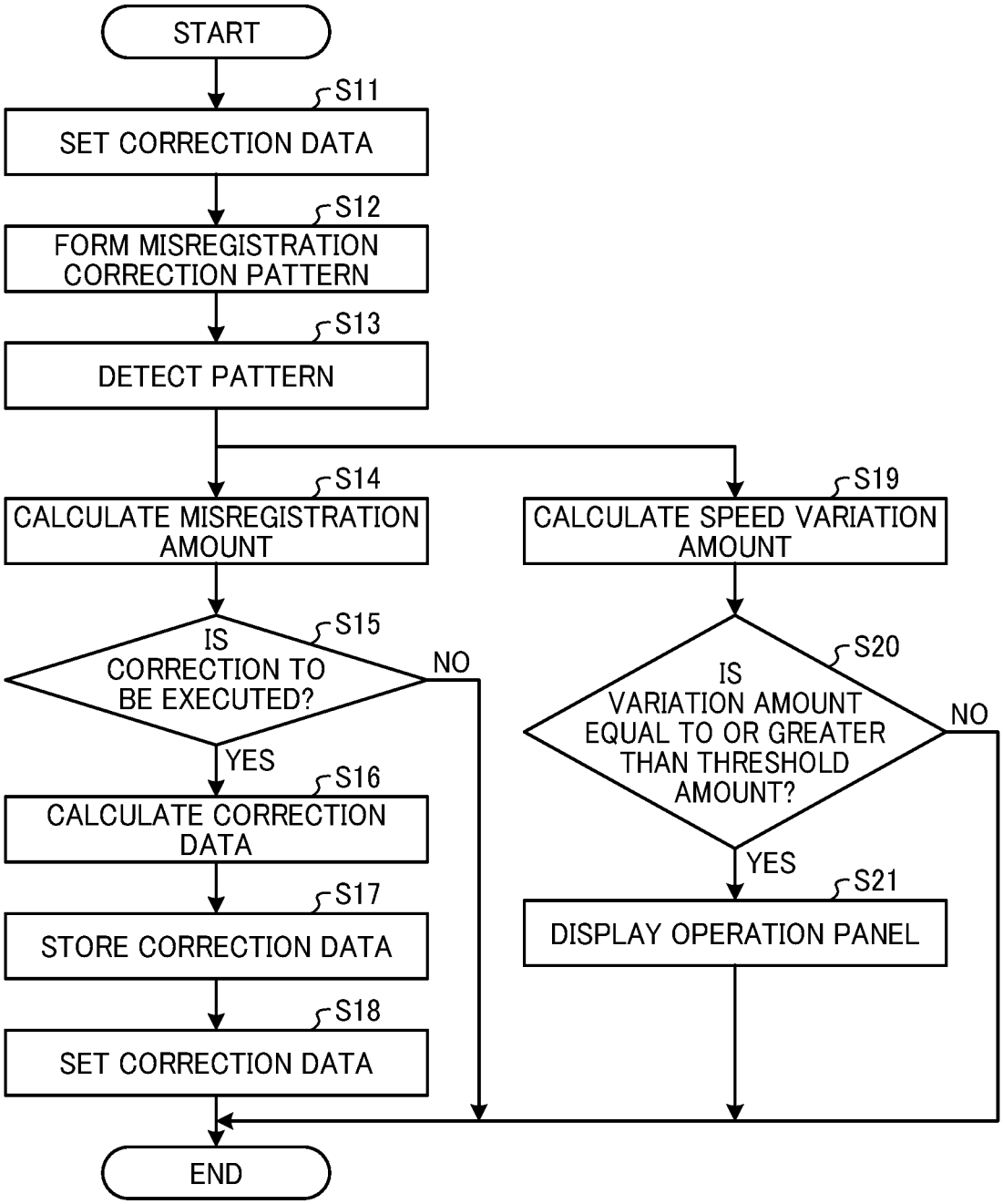
FIG. 12 is a flowchart illustrating the procedure of an image-misregistration correction process executed based on functions of the printer controller.

FIG. 12 is a flowchart illustrating the procedure of an image-misregistration correction process executed based on the functions of the printer controller 87. The printer controller 87 controls the timing of execution of the image-misregistration correction process described below. For example, the image-misregistration correction process is executed at a timing immediately after the power source is turned on, a timing immediately before printing, a timing when the number of printed sheets reaches a specified number, or a timing when the monitored temperature becomes equal to or higher than a predetermined temperature (a timing when a predetermined temperature change occurs).

In step S11 of the flowchart of FIG. 12, the correction-data setting unit 110 sets the correction data stored in the storage device 88 to the writing-start-position controller 81, the LD controller 82, the synchronization detection lighting controller 83, and the pixel clock generator 130. In step S12, the pattern-formation control unit 111 forms an image-misregistration correction pattern. In step S13, the pattern detection unit 112 detects the image-misregistration correction pattern formed on the intermediate transfer belt 10 based on the sensor outputs of the first sensor 61 and the second sensor 62. In step S14, the misregistration-amount calculation unit 113 calculates a misregistration amount (color-deviation amount) of each color with respect to the reference color based on the image-misregistration correction pattern detected by the pattern detection unit 112. When a plurality of sets of image-misregistration detection patterns are formed, the misregistration-amount calculation unit 113 calculates an average value of misregistration amounts of respective colors to reduce an error.

In step S15, the determination unit 114 determines whether to perform image misregistration correction based on the calculated deviation amount of each color with respect to the reference color. For example, if the misregistration amount is equal to or greater than a half of the correction resolution, the determination unit 114 determines that correction is to be performed. In a case where the calculated misregistration amount of each color is less than the half of the correction resolution, correction is not necessary (No in step S15) and thus the process of the flowchart of FIG. 12 is ended.

On the other hand, when the calculated misregistration amount of each color is equal to or greater than the half of the correction resolution, correction is necessary (Yes in step S15) and thus the correction-data calculating unit 115 calculates correction data (step S16). The "correction data" includes a set value of a pixel clock frequency for determining an image magnification in the main scanning direction, a set value of an XLGATE signal for determining an image position in the main scanning direction, and a set value of an XFGATE signal for determining an image position in the sub-scanning direction.

In step S17, the storage control unit 116 updates the correction data stored in the storage device 88 with the calculated correction data. Thus, the updated correction data are newly set to the writing-start-position controller 81, the LD controller 82, the synchronization detection lighting controller 83, and the pixel clock generator 130 (step S18), and the printing process described with reference to FIG. 10 is performed.

Warning Operation Based on Variation Amount of Drive System

On the other hand, in the color image forming apparatus 1 according to the first embodiment, when the image-misregistration detection pattern is detected in step S13, the misregistration amount of each color is calculated in step S14. In step S19, the speed-variation-amount calculation unit 118 calculates the speed variation amount of the drive system 60 such as the photoconductor 40 and the intermediate transfer belt 10 on which the image-misregistration detection patterns are formed.

In step S20, the speed-variation-amount calculation unit 118 determines whether the variation amount of the drive system 60 is equal to or greater than a predetermined value. When the variation amount of the drive system 60 is less than the predetermined amount (No in step S20), the process illustrated in the flowchart of FIG. 12 is ended.

On the other hand, when the variation amount of the drive system 60 is equal to or greater than the predetermined amount (Yes in step S20), the display control unit 119, which is an example of a notification unit, displays an error message (warning) indicating that there is a possibility that an image misregistration has occurred on the display such as an operation panel (step S21).

As an example, the display control unit 119 displays, for example, an error message "there is a possibility that an image misregistration has occurred" on the display. Such a message allows the user to recognize that an image misregistration has occurred due to the influence of a failure of the drive system 60. The user who sees such an error message checks the drive system 60, adjusts the misregistration amount of the image position to be equal to or less than a predetermined misregistration amount, and then resumes printing.

In this example, an error message indicating that an image misregistration has occurred is displayed. However, an error message indicating that an image misregistration has occurred may be output by voice or an electronic sound indicating that an image misregistration has occurred may be output. Alternatively, light emission of a light emitting diode or the like may be controlled to emit light indicating that an image misregistration has occurred.

Examples of Detection Error

Figure 13:
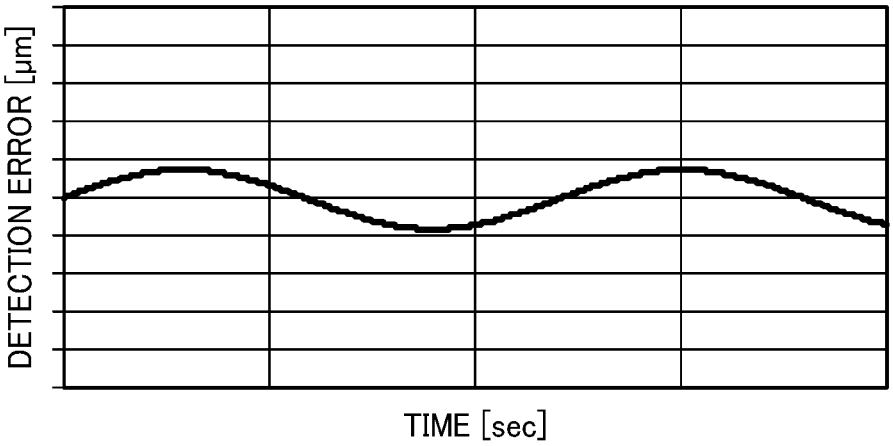
FIG. 13 is a diagram illustrating a detection error of an image-misregistration detection pattern.

FIG. 13 is a diagram illustrating a detection error of an image-misregistration detection pattern. That is, FIG. 13 illustrates an example of a detection error of an image-misregistration detection pattern in a case where there is a speed variation in the drive system 60 such as the photoconductor 40 and the intermediate transfer belt 10. In the case where the periodic variation of the image-misregistration detection patterns detected by the first sensor 61 and the second sensor 62 and is the periodic fluctuation as illustrated in FIG. 13, the detection error may be reduced by increasing the number of image-misregistration detection patterns, detecting a plurality of patterns, and averaging the detection outputs.

However, the detection error may not be reduced when the amplitude (detection error) fluctuates and when the period of fluctuation is long with respect to the time during which the image-misregistration detection pattern is formed. For this reason, as described in step S20 and step S21, the variation amount of the drive system 60 is detected to notify the abnormality.

Details of Operation of Calculating Image Misregistration Amount

Figure 14:
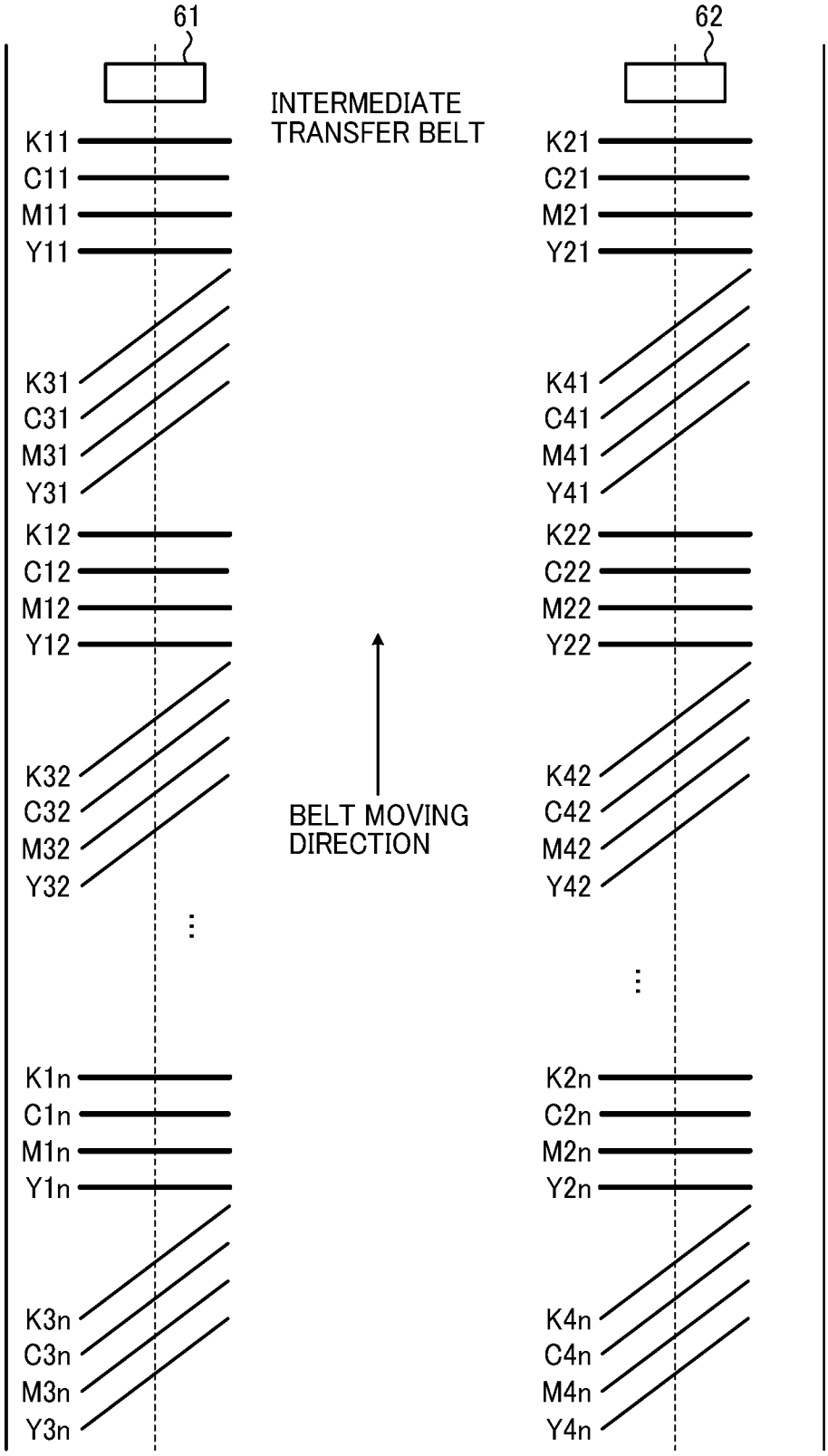
FIG. 14 is a diagram illustrating an example of image-misregistration detection patterns.

FIG. 14 is a diagram illustrating an example of an image-misregistration detection pattern. The pattern-formation control unit 111 illustrated in FIG. 11 forms an image-misregistration detection pattern in a period (e.g., sheet interval) in which an image to be printed is not formed. The image-misregistration detection pattern may be formed before the start of printing or at the end of printing.

The photoconductors 40 form horizontal line patterns (including lines of K11, C11, M11, and Y11, lines of K21, C21, M21, and Y21, lines of K12, C12, M12, and Y12, lines of K22, C22, M22, and Y22, . . . ) and oblique line patterns (including lines of K31, C31, M31, and Y31, lines of K41, C41, M41, and Y41, lines of K32, C32, M32, and Y32, lines of K42, C42, M42, and Y42, . . . ) for different colors on the intermediate transfer belt 10.

The first sensor 61 or the second sensor 62 sequentially detects the horizontal line pattern and the oblique line pattern of each color when the intermediate transfer belt 10 moves in the belt moving direction (sub-scanning direction) indicated by the arrow in FIG. 14, which is the direction in which the image-misregistration detection patterns are formed. The detection output of each pattern is supplied from each of the first sensor 61 and the second sensor 62 to the misregistration-amount calculation unit 113 and the speed-variation-amount calculation unit 118 of the printer controller 87.

Details of Calculation Operation of Variation Amount of Drive System

Next, such an image-misregistration detection pattern can be used to determine the state of the drive system 60 based on a change in the pattern position, in addition to calculating the correction value of the image misregistration amount.

That is, since the plurality of sets of patterns are formed on the intermediate transfer belt 10 to have a preset distance therebetween, the pattern intervals of the same color are constant. However, when the speed of the photoconductor 40 that scans the light beam and the speed of the intermediate transfer belt 10 on which the image-misregistration detection pattern is formed varies, the pattern interval varies due to the influence of the variation. Therefore, the state of the drive system 60 can be determined by calculating the variation amount with respect to the distance set in advance by the speed-variation-amount calculation unit 118.

To be specific, the speed-variation-amount calculation unit 118 defines that a specified value is calculated from a preset value, and calculates "ΔL_K11", which is a difference (absolute value) between the specified value "A" and "L_K11" that is an interval between a horizontal line pattern K11 and a horizontal line pattern K12, for the horizontal line patterns of black detected by the first sensor 61. Similarly, the speed-variation-amount calculation unit 118 calculates "ΔL_K12(n−1)" that is a difference (absolute value) from the specified value "A", which is an example of a reference value, for each of a plurality of sets of patterns including a set of K12 to K13, a set of K1*n*−1 to K1*n*, and so forth.

The speed-variation-amount calculation unit 118 compares each of the (n−1) calculation results with a determination value "X" that is an example of a predetermined threshold value, determines the presence or absence of an abnormality of the drive system 60 based on, for example, a first condition and a second condition described below, and notifies the display control unit 119 of the determination result. Note that the determination value "X" is a value determined in advance based on the degree of influence on the image misregistration.

First condition: when the maximum value of the (n−1) calculation results is less than X, the speed-variation-amount calculation unit 118 determines that the variation is an assumed variation, and notifies the display control unit 119 of "no abnormality (normal)".

Second condition: in a case where the maximum value of the (n−1) calculation results is equal to or greater than X, the speed-variation-amount calculation unit 118 determines that the variation is an unexpected variation and notifies the display control unit 119 of "abnormality".

The speed-variation-amount calculation unit 118 detects an abnormality of the drive system 60 in the same manner as described above using a diagonal line pattern in addition to the horizontal line pattern described above, and notifies the display control unit 119 of the abnormality.

The speed-variation-amount calculation unit 118 also detects an abnormality of the drive system 60 in the same manner as described above using the image-misregistration detection pattern detected by the second sensor 62, and notifies the display control unit 119 of the abnormality.

In addition, the speed-variation-amount calculation unit 118 detects an abnormality of the drive system 60 in the same manner as described above using the image-misregistration detection patterns of cyan, magenta, and yellow, which are colors other than black, and notifies the display control unit 119 of the abnormality. The speed-variation-amount calculation unit 118 detects an abnormality of the drive system 60 as described above using the image-misregistration detection patterns of black, cyan, magenta, and yellow. When an abnormality of the drive system 60 is detected based on the image-misregistration detection patterns of any one color or a plurality of colors, the speed-variation-amount calculation unit 118 notifies the display control unit 119 that an abnormality of the drive system 60 has occurred in any one color.

Abnormality Occurrence Notification Specifying Color

The speed-variation-amount calculation unit 118 detects an abnormality of the drive system 60 based on the image-misregistration detection patterns of the respective colors of black, cyan, magenta, and yellow. When an abnormality of the drive system 60 is detected, the speed-variation-amount calculation unit 118 notifies the display control unit 119 of the color in which the abnormality is detected and the occurrence of the abnormality of the drive system 60.

For example, in a case where an abnormality occurs in black that is a reference color for image misregistration correction, the abnormality in black may affect all colors. For example, in a case where repair is necessary, it is easier to find out the cause of the abnormality if the color in which the abnormality occurs is specified. Therefore, notifying both of the occurrence of the image misregistration and the color in which the abnormality such as black is detected can facilitate specifying the location of the abnormality.

Abnormality Occurrence Notification Specifying Pattern Position

The speed-variation-amount calculation unit 118 performs abnormality detection of the drive system 60 described above for each set of patterns such as a set of K11 to Y11, a set of K21 to Y21, a set of K12 to Y12, and a set of K22 to Y22, and notifies that an abnormality of the drive system 60 has occurred together with the position of the pattern in which the abnormality has been detected.

As described above, the image misregistration correction is performed based on the misregistration amount calculated by averaging the detection values of the first sensor 61 and the second sensor 62. However, even in a case where an abnormality is detected by one of the first sensor 61 and the second sensor 62, there is a possibility that an image misregistration occurs. For this reason, notifying both the occurrence of the image misregistration and the position of the pattern in which the abnormality is detected can facilitate specifying the location of the abnormality and performing repair or the like.

First Modification

The abnormality detection may be performed separately for each color and each position of the pattern (e.g., front side or back side). In a case where the presence or absence of an abnormality changes depending on the position of the first sensor 61 and the second sensor 62, for example, the notification may be performed with the position such as the front side or the back side designated.

Print Control after Image Misregistration Correction

Figure 15:
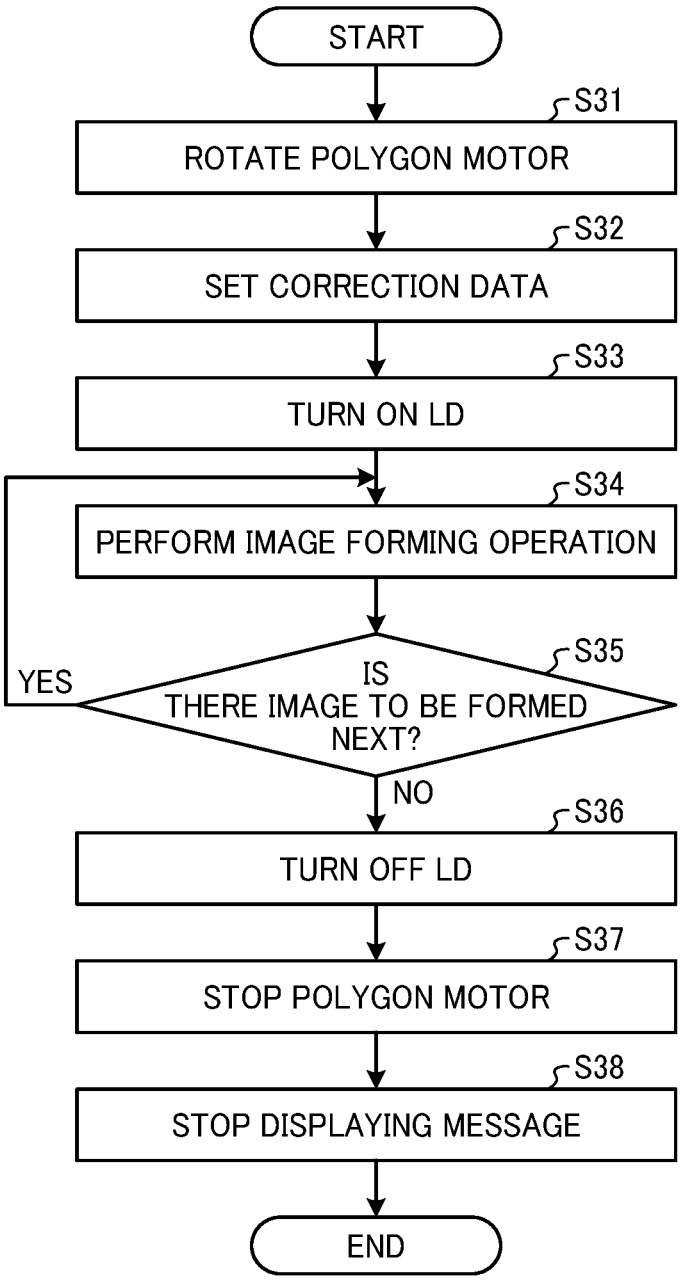
FIG. 15 is a flowchart illustrating the process of print control after image misregistration correction in the color image forming apparatus according to the first embodiment.

Next, FIG. 15 is a flowchart illustrating the process of print control after image misregistration correction in the color image forming apparatus 1 according to the first embodiment. In the flowchart of FIG. 15, when the start key of the operation panel is operated, the printer controller 87 controls the polygon motor controller 80 to rotate the polygon motor at a specified rotation speed based on printing conditions (step S31).

Next, the printer controller 87 sets the correction data (the writing start positions in the main scanning direction and the sub-scanning direction, and the magnification setting values) calculated as described above and updated in the storage device 88 to the writing-start-position controller 81, the LD controller 82, the synchronization detection lighting controller 83, and the pixel clock generator 130 (step S32). Thus, the LDs for outputting the synchronization detection signal can be turned on, and each LD can be turned on with a specified light amount (APC operation: step S33).

Thereafter, the printer controller 87 starts an image forming operation (step S34). If there is no next image (No in step S35), the printer controller 87 controls the LD controller 82 to turn off each LD (step S36). The printer controller 87 controls the polygon motor controller 80 to stop the polygon motor (step S37).

Next, when printing is performed in this manner, the user can visually recognize whether an image misregistration has actually occurred, based on the printed matter. Therefore, the display control unit 119 controls the display so that the message is not displayed (notification is cancelled) at the end of printing (step S38). Thus, the process of the flowchart of FIG. 15 ends.

When the occurrence of the image misregistration is visually recognized based on the printed matter, the above-described image misregistration correction operation is executed again by the printer controller 87 after the end of the printing, and the correction process of the image misregistration is performed.

Second Modification

Here, the color image forming apparatus 1 according to the first embodiment can specify and notify a color in which an abnormality is detected as described above. In this case, the display control unit 119 controls the display to display an error message such as "there is a possibility that an abnormality has occurred in cyan".

Figure 16:
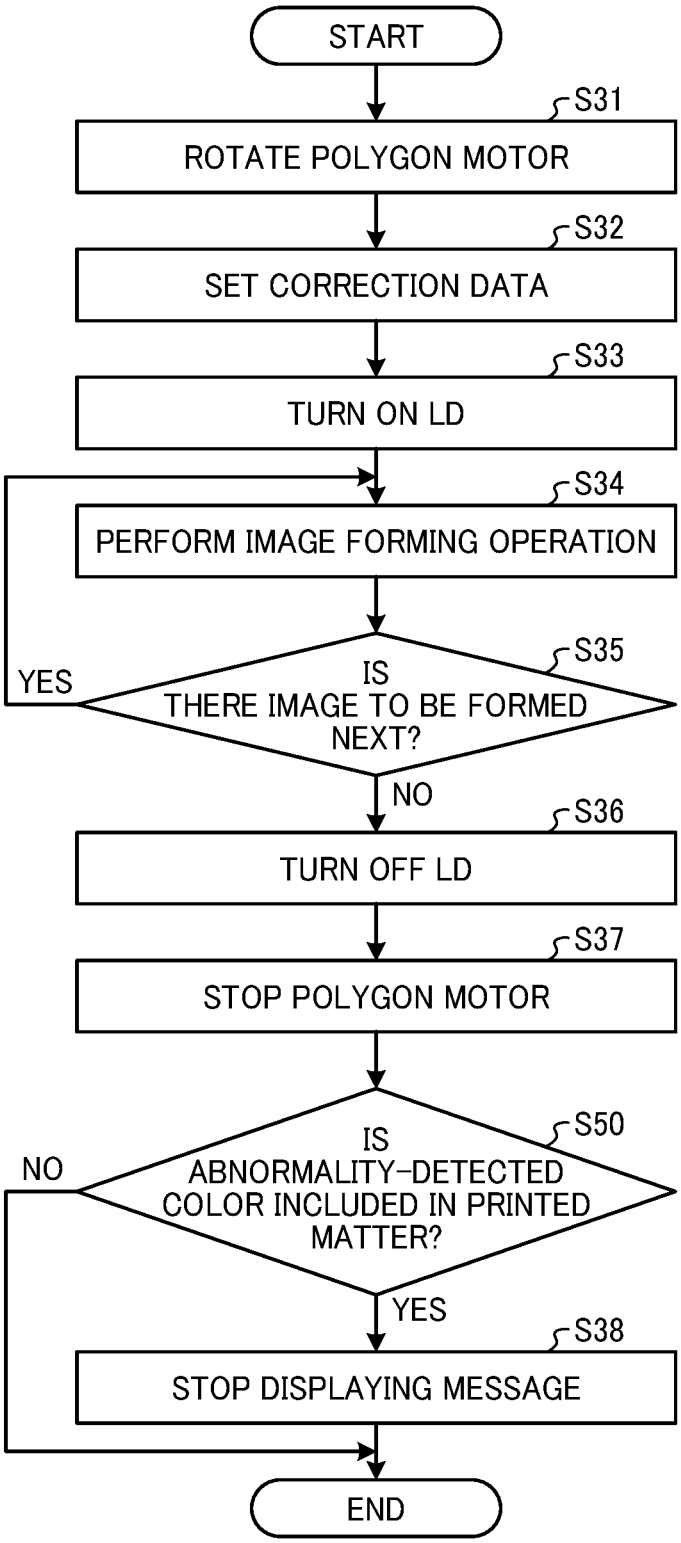
FIG. 16 is a flowchart illustrating a second modification of the first embodiment.

However, when the printed image does not include cyan, it would be difficult for the user to determine whether there is an actual abnormality from the printed matter. For this reason, as illustrated in the flowchart of FIG. 16, the display control unit 119 determines whether a color in which an abnormality has been detected is included in the printed matter in step S50 after the end of printing. In a case where the color in which the abnormality has been detected is included in the printed matter (Yes in step S50), the user can determine the presence or absence of the abnormality based on the printed matter. Thus, the display control unit 119 hides the above-described error message in step S38 and ends the process of the flowchart of FIG. 16. The processing from step S31 to step S37 in the flowchart of FIG. 16 is the same processing as the processing of the same step numbers in the flowchart of FIG. 15.

On the other hand, in a case where the color in which the abnormality has been detected is not included in the printed matter (No in step S50), it is difficult for the user to determine the presence or absence of the abnormality based on the printed matter. Thus, the display control unit 119 ends the process of the flowchart of FIG. 16 while keeping the error message displayed on the display. In this case, the image-misregistration correction process is performed after the end of printing, and the image misregistration is corrected. The error message after the correction may be hidden, or the error message may be continuously displayed until the printed matter including the color in which the abnormality has been detected is printed.

Advantageous Effects of First Embodiment

As is clear from the above description, the color image forming apparatus 1 according to the first embodiment forms a plurality of sets of image-misregistration detection patterns. Since the image-misregistration detection patterns are generated to have a preset interval (distance), the interval between image-misregistration detection patterns of the same color is to be constant. However, if there is a variation in the speed of the photoconductor that scans the beam and the transfer belt that transfers the image-misregistration detection pattern, the interval between the image-misregistration detection patterns varies due to the influence of the variation. For this reason, the color image forming apparatus 1 according to the present embodiment determines the state of the drive system 60 and detects the variation amount of the interval of the image-misregistration detection patterns with respect to the interval (distance) set in advance, to notify the user of the state of the drive system 60. Such a configuration can prevent erroneous image misregistration correction from being performed in a state in which a variation occurs in the drive system 60, thus preventing such erroneous image misregistration correction from degrading the image quality.

Second Embodiment

Next, a color image forming apparatus according to a second embodiment is described. The color image forming apparatus 1 according to the first embodiment described above is an example in which the speed-variation-amount calculation unit 118 determines whether there is an abnormality in the driving state of the drive system 60 based on the following first condition and second condition, and performs notification.

First condition: when the maximum value of the (n−1) calculation results is less than X, the speed-variation-amount calculation unit 118 determines that the variation is an assumed variation, and notifies the display control unit 119 of "no abnormality (normal)".

Second condition: in a case where the maximum value of the (n−1) calculation results is equal to or greater than X, the speed-variation-amount calculation unit 118 determines that the variation is an unexpected variation and notifies the display control unit 119 of "abnormality".

On the other hand, the color image forming apparatus according to the second embodiment is an example in which the presence or absence of an abnormality in the driving state of the drive system 60 is determined and notified based on third to sixth conditions described below together with the first condition and the second condition described above. The first embodiment described above and the second embodiment described below differ from each other in this point. Therefore, hereinafter, the difference between the two will be described, and redundant description will be omitted.

That is, in the case of the color image forming apparatus according to the second embodiment, the speed-variation-amount calculation unit 118 calculates an added value of (n−1) calculation results together with the maximum value of the (n−1) calculation results. Based on the maximum value and the added value, the presence or absence of an abnormality in the driving state of the drive system 60 is determined based on the following third to sixth conditions, and a notification is performed. As the maximum value "X" and the added value "Y" used for this determination, values determined in advance based on the degree of influence on the image misregistration are used. Such an added value is zero when the variation amount is the same amount on each of the plus side and the minus side. However, when the variation amount is greater on one of the plus side and the minus side than the other, the added value increases, and it can be seen that there is no periodic variation. For this reason, the speed-variation-amount calculation unit 118 determines whether there is an abnormality in the drive system 60 based on the maximum value of (n−1) calculation results and an added value of the (n−1) calculation results as follows.

Third condition: when the maximum value is less than X and the added value is less than Y, the speed-variation-amount calculation unit 118 determines that the variation is within the assumption, and notifies "no abnormality (normal)".

Fourth condition: when the maximum value is equal to or greater than X and the added value is less than Y, the speed-variation-amount calculation unit 118 determines that the variation is an unexpected variation, and notifies that "abnormality is present".

Fifth condition: when the maximum value is less than X and the added value is equal to or greater than Y, the speed-variation-amount calculation unit 118 determines that the variation is within the assumption, and notifies "no abnormality (normal)".

Sixth condition: when the maximum value is equal to or greater than X and the added value is equal to or greater than Y, the speed-variation-amount calculation unit 118 determines that the variation is an unexpected variation, and notifies that "abnormality is present".

The speed-variation-amount calculation unit 118 also makes such a determination based on the oblique line pattern and based on the detection output of the pattern of the second sensor 62. Similarly, the speed-variation-amount calculation unit 118 makes the determination for patterns of cyan, magenta, and yellow other than black.

Such a configuration can determine the driving state of the drive system 60 in more detail to perform abnormality notification, and can also obtain the same effects as those of the first embodiment described above.

Third Embodiment

Next, a color image forming apparatus according to a third embodiment is described. The color image forming apparatus according to the third embodiment is an example in which three rows of image-misregistration detection patterns are formed on the intermediate transfer belt 10. Note that the first embodiment or the second embodiment described above is different from the third embodiment described below in this point. Therefore, hereinafter, the difference between the two will be described, and redundant description will be omitted.

Figure 17:
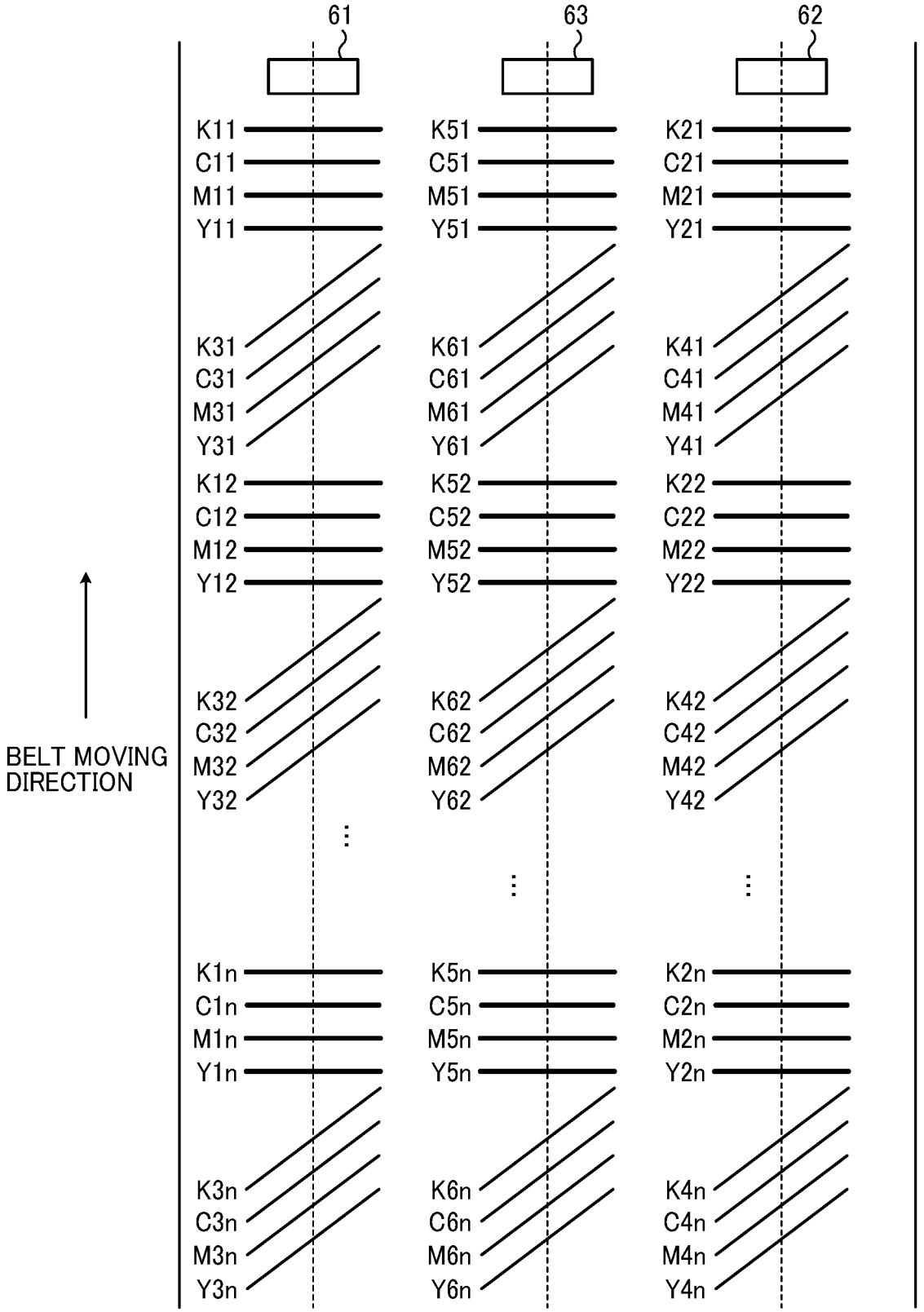
FIG. 17 is a diagram illustrating image-misregistration detection patterns according to a third embodiment of the present disclosure.
Figure 18:
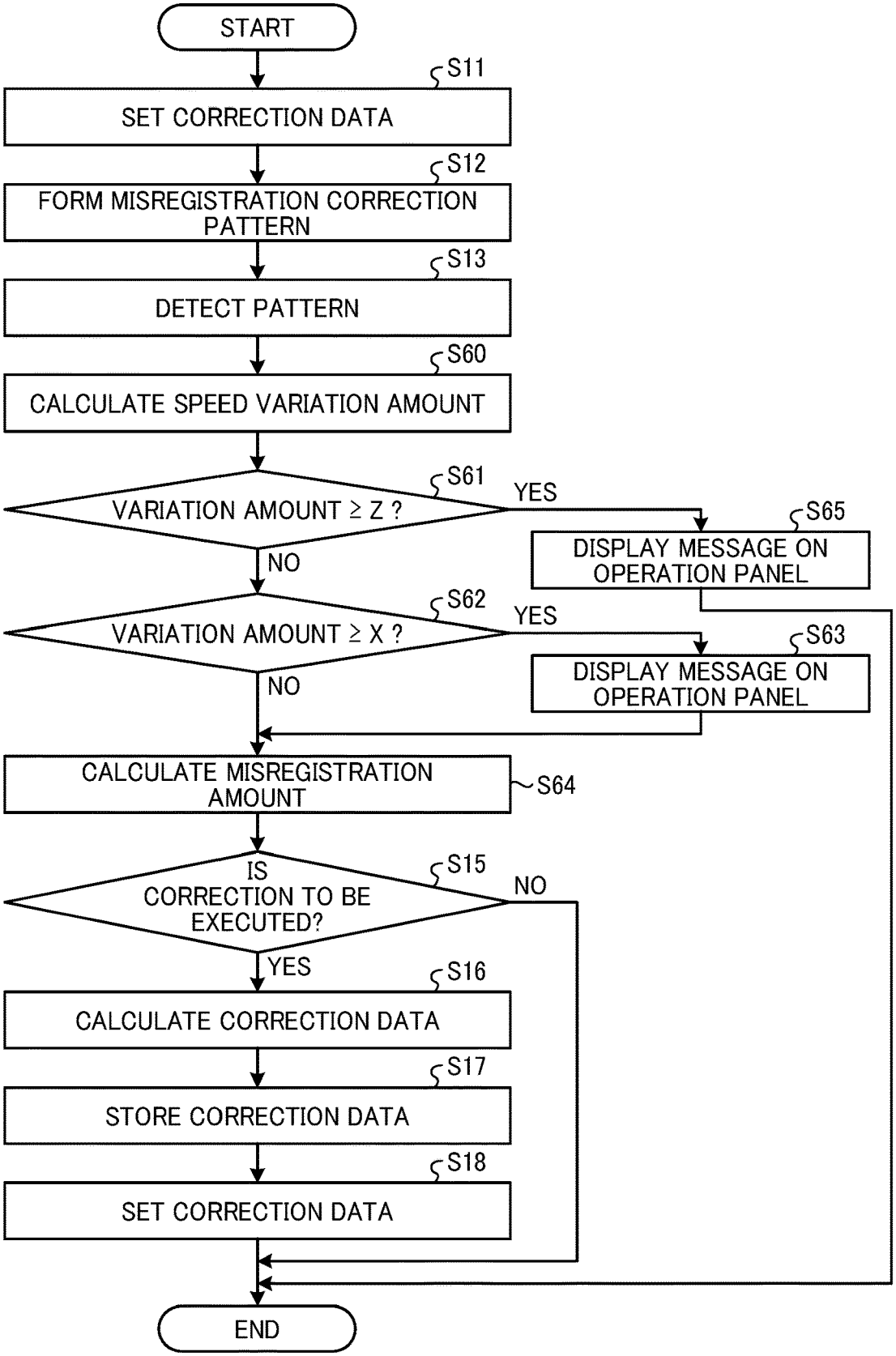
FIG. 18 is a flowchart illustrating the procedure of an image-misregistration correction process executed based on functions of a printer controller according to the third embodiment.

FIGS. 17 and 18 illustrate a third embodiment of the present disclosure.

FIG. 17 is a diagram illustrating image-misregistration detection patterns according to the third embodiment. Although the two sensors are disposed in FIG. 14, three sensors are disposed in the third embodiment.

Here, a third sensor 63 in the middle in the third embodiment is disposed to correct a deviation between the main scanning magnification on the front side (left side illustrated in FIG. 17) and the main scanning magnification on the back side (right side illustrated in FIG. 17). Since the deviation amount is calculated by the average value of the three positions of the first sensor 61, the second sensor 62, and the third sensor 63, the third sensor 63 is disposed to enhance the accuracy of correcting the deviation in the sub-scanning direction. Therefore, in a period (e.g., sheet interval) in which an image to be printed is not formed, three rows of image-misregistration detection patterns are formed. The detection state of the third sensor 63 is also calculated for misregistration correction in addition to the first sensor 61 and the second sensor 62.

The pattern-formation control unit 111 illustrated in FIG. 11 forms an image-misregistration detection pattern illustrated in FIG. 17 in a period (e.g., sheet interval) in which an image to be printed is not formed. Note that the image-misregistration detection pattern may be formed before the start of printing, at the end of printing, or when image formation is interrupted during continuous printing.

The photoconductors 40 form horizontal line patterns (including lines of K11, C11, M11, and Y11, lines of K21, C21, M21, and Y21, lines of K51, C51, M51, and Y51, lines of K12, C12, M12, and Y12, lines of K22, C22, M22, and Y22, lines of K52, C52, M52, and Y52, . . . ) and oblique line patterns (including lines of K31, C31, M31, and Y31, lines of K41, C41, M41, and Y41, lines of K61, C61, M61, and Y61, lines of K32, C32, M32, and Y32, lines of K42, C42, M42, and Y42, lines of K62, C62, M62, and Y62, . . . ) for different colors on the intermediate transfer belt 10.

The first sensor 61, the second sensor 62, or the third sensor 63 sequentially detects the horizontal line pattern and the oblique line pattern of each color when the intermediate transfer belt 10 moves in the belt moving direction (sub-scanning direction) indicated by the arrow in FIG. 17, which is the direction in which the image-misregistration detection pattern is formed. The detection output of each pattern is supplied from each of the first sensor 61, the second sensor 62, and the third sensor 63 to the misregistration-amount calculation unit 113 and the speed-variation-amount calculation unit 118 of the printer controller 87.

Details of Calculation Operation of Variation Amount of Drive System

Next, such an image-misregistration detection pattern can be used to determine the state of the drive system 60 based on a change in the pattern position, in addition to calculating the correction value of the image misregistration amount.

That is, since the plurality of sets of patterns are formed on the intermediate transfer belt 10 to have a preset distance therebetween, the pattern intervals of the same color are constant. However, when the speed of the photoconductor 40 that scans the light beam and the speed of the intermediate transfer belt 10 on which the image-misregistration detection pattern is formed varies, the pattern interval varies due to the influence of the variation. Therefore, the state of the drive system 60 can be determined by calculating the variation amount with respect to the distance set in advance by the speed-variation-amount calculation unit 118.

To be specific, the speed-variation-amount calculation unit 118 defines that a specified value is calculated from a preset value, and calculates "ΔL_K11", which is a difference (absolute value) between the specified value "A" and "L_K11" that is an interval between a horizontal line pattern K11 and a horizontal line pattern K12, for the horizontal line patterns of black detected by the first sensor 61. Similarly, the speed-variation-amount calculation unit 118 calculates "ΔL_K12(*n*−1)" that is a difference (absolute value) from the specified value "A", which is an example of a reference value, for each of a plurality of sets of patterns including a set of K12 to K13, a set of K1*n*−1 to K1*n*, and so forth.

The speed-variation-amount calculation unit 118 compares each of the (n−1) calculation results with a determination value "X" and a determination value "Z" that are an example of predetermined threshold values, determines the presence or absence of an abnormality of the drive system 60 based on, for example, a first condition, a second condition, and a third condition described below, and notifies the display control unit 119 of the determination result. Note that each of the determination value "X" and the determination value "Z" is a value determined in advance based on the degree of influence on the image misregistration.

First condition: when the maximum value of (n−1) calculation results are equal to or greater than Z, the speed-variation-amount calculation unit 118 determines that the variation is an unexpected variation and notifies the display control unit 119 of "correction stop".

Second condition: when the maximum value of the (n−1) calculation results is less than X, the speed-variation-amount calculation unit 118 determines that the variation is an assumed variation, and notifies the display control unit 119 of "no abnormality (normal)".

Third condition: in a case where the maximum value of the (n−1) calculation results is equal to or greater than X, the speed-variation-amount calculation unit 118 determines that the variation is an unexpected variation and notifies the display control unit 119 of "abnormality".

The speed-variation-amount calculation unit 118 calculates an added value of (n−1) calculation results together with the maximum value of the (n−1) calculation results. Based on the maximum value and the added value, the presence or absence of an abnormality in the driving state of the drive system 60 is determined based on the following fourth to seventh conditions, and a notification is performed. As the maximum value "X" and the added value "Y" used for this determination, values determined in advance based on the degree of influence on the image misregistration are used. Such an added value is zero when the variation amount is the same amount on each of the plus side and the minus side. However, when the variation amount is greater on one of the plus side and the minus side than the other, the added value increases, and it can be seen that there is no periodic variation. For this reason, the speed-variation-amount calculation unit 118 determines whether there is an abnormality in the drive system 60 based on the maximum value of (n−1) calculation results and an added value of the (n−1) calculation results as follows.

Fourth condition: when the maximum value is less than X and the added value is less than Y, the speed-variation-amount calculation unit 118 determines that the variation is within the assumption, and notifies "no abnormality (normal)".

Fifth condition: when the maximum value is equal to or greater than X and the added value is less than Y, the speed-variation-amount calculation unit 118 determines that the variation is an unexpected variation, and notifies that "abnormality is present".

Sixth condition: when the maximum value is less than X and the added value is equal to or greater than Y, the speed-variation-amount calculation unit 118 determines that the variation is within the assumption, and notifies "no abnormality (normal)".

Seventh condition: when the maximum value is equal to or greater than X and the added value is equal to or greater than Y, the speed-variation-amount calculation unit 118 determines that the variation is an unexpected variation, and notifies that "abnormality is present".

With respect to the determination value "Z", the presence or absence of an abnormality in the driving state of the drive system 60 is determined based on the fourth to seventh conditions described above (in which "X" is replaced with "Z" and detailed description thereof is omitted), and notification is performed.

The speed-variation-amount calculation unit 118 also makes such a determination based on the oblique line pattern and based on the detection outputs of the patterns of the second sensor 62 and the third sensor 63. Similarly, the speed-variation-amount calculation unit 118 makes the determination for patterns of cyan, magenta, and yellow other than black.

Such a configuration can determine the driving state of the drive system 60 in more detail to perform abnormality notification, and can also obtain the same effects as those of the first embodiment described above.

The abnormality detection may be performed separately for each color and each position of the pattern (e.g., front side, center, or back side). In a case where the presence or absence of an abnormality changes depending on the position of the first sensor 61, the second sensor 62, and the third sensor 63, for example, the notification may be performed with the position such as the front side, center, or the back side designated.

With regard to the designation of color, when an abnormality occurs in black that is a reference color for image misregistration correction, the abnormality in black might affect all colors. Therefore, for example, when repair is necessary, the designation of color facilitates investigation of the cause of the abnormality. For this reason, it is preferable to notify both the occurrence of the image misregistration and the abnormality of black. With regard to the designation of the position, since the image misregistration correction control calculates the misregistration amount by averaging the detection values of the respective sensors, there is a possibility that the image misregistration occurs even if the abnormality occurs at only one position. However, in a case where repair is necessary, the designation of the position facilitates the investigation of the cause. Therefore, it is preferable to notify both the occurrence of image misregistration and the position where there is an abnormality.

Image-Misregistration Correction Process

FIG. 18 is a flowchart illustrating the procedure of image-misregistration correction process in the case of the image-misregistration detection pattern illustrated in FIG. 17.

In step S11, the correction-data setting unit 110 sets correction data stored in the storage device 88 to the writing-start-position controller 81, the LD controller 82, the synchronization detection lighting controller 83, and the pixel clock generator 130. In step S12, the pattern-formation control unit 111 forms an image-misregistration correction pattern. In step S13, the pattern detection unit 112 detects the image-misregistration correction pattern formed on the intermediate transfer belt 10 based on the sensor outputs of the first sensor 61, the second sensor 62, and the third sensor 63.

When the image-misregistration detection pattern is detected, in step S60, the speed-variation-amount calculation unit 118 calculates the speed variation amount of the drive system 60 such as the photoconductor 40 and the intermediate transfer belt 10 on which the image-misregistration detection pattern is formed.

In step S61, when the variation amount is equal to or larger than the determination value "Z" described above, there is a possibility that the misregistration amount is increased by the correction and the image misregistration correction is not normally performed. For this reason, the cancellation of the correction is displayed on, for example, the operation panel (step S65), and the process is ended.

In step S61, when the variation amount is less than the determination value "Z" described above, the speed-variation-amount calculation unit 118 determines whether the variation amount is greater than a determination value "X" that is less than the determination value "Z" (step S62).

In step S62, when the variation amount is equal to or larger than the determination value "X" described above, the possibility of occurrence of the image misregistration after the correction is displayed on, for example, the operation panel (step S63), and the possibility of abnormality is notified.

In step S62, when the variation amount is less than the above-described determination value "X", the determination unit 114 calculates the misregistration amount of each color with respect to the reference color (step S64), and determines whether to perform image misregistration correction based on the calculated misregistration amount of each color with respect to the reference color (step S15).

For example, if the misregistration amount is equal to or greater than a half of the correction resolution, the determination unit 114 determines that correction is to be performed. In a case where the calculated misregistration amount of each color is less than the half of the correction resolution, correction is not necessary (No in step S15) and thus the process of the flowchart of FIG. 18 is ended.

On the other hand, when the calculated misregistration amount of each color is equal to or greater than the half of the correction resolution, correction is necessary (Yes in step S15) and thus the correction-data calculating unit 115 calculates correction data (step S16). The "correction data" includes a set value of a pixel clock frequency for determining an image magnification in the main scanning direction, a set value of an XLGATE signal for determining an image position in the main scanning direction, and a set value of an XFGATE signal for determining an image position in the sub-scanning direction.

In step S17, the storage control unit 116 updates the correction data stored in the storage device 88 with the calculated correction data. Thus, the updated correction data are newly set to the writing-start-position controller 81, the LD controller 82, the synchronization detection lighting controller 83, and the pixel clock generator 130 (step S18), and the printing process described with reference to FIG. 10 is performed.

Modification of Third Embodiment

In the third embodiment, three rows of image-misregistration detection patterns are formed on the intermediate transfer belt 10. However, in the present modification, patterns to be formed are different depending on conditions.

Figure 19:
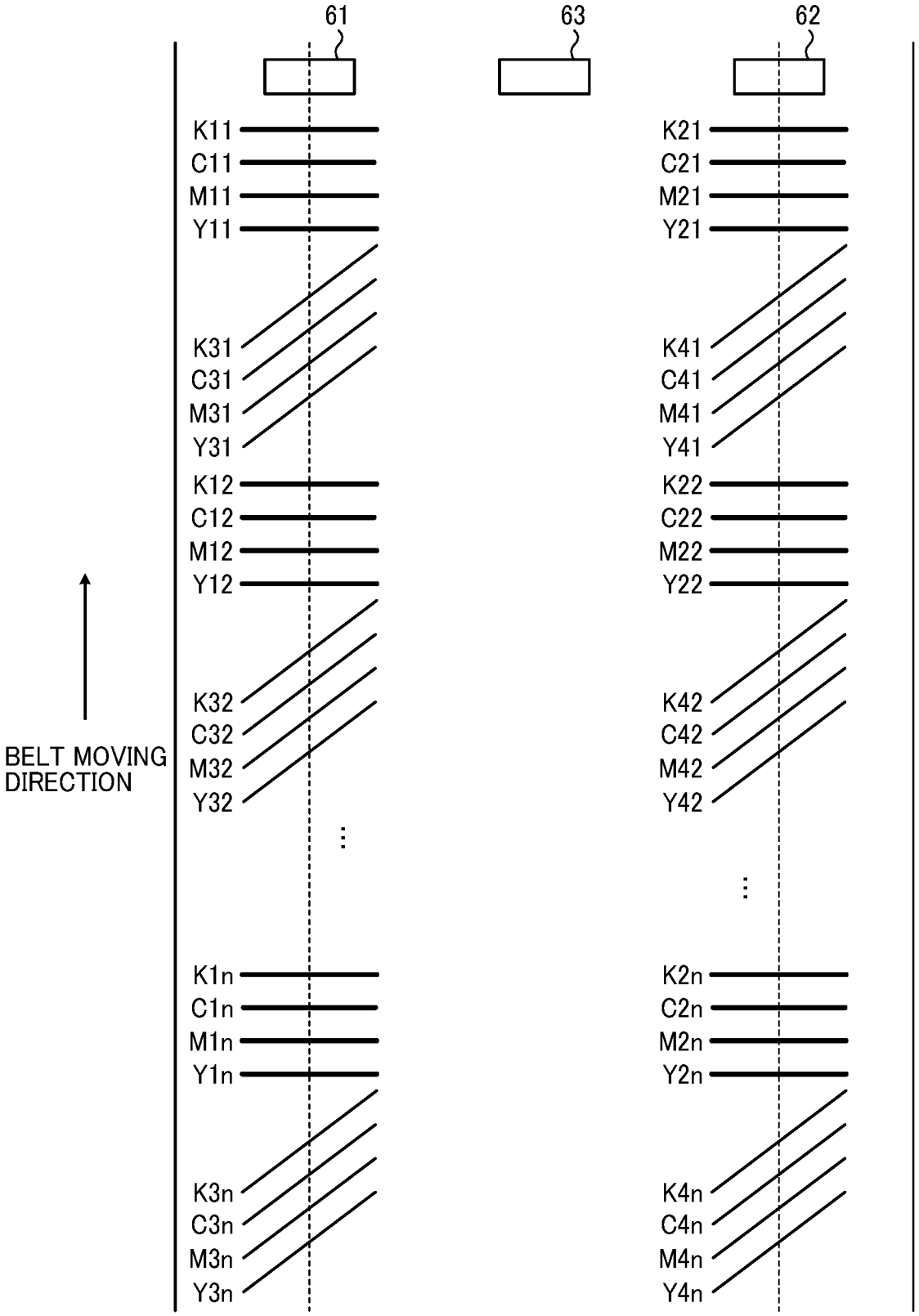
FIG. 19 is a diagram illustrating an example of image-misregistration detection patterns according to a modification of the third embodiment.

FIG. 19 is a diagram illustrating an example of image-misregistration detection patterns according to a modification of the third embodiment. The pattern-formation control unit 111 illustrated in FIG. 11 forms image-misregistration detection patterns illustrated in FIG. 19 in a period (e.g., sheet interval) in which an image to be printed is not formed.

On the other hand, before the start of printing, at the end of printing, or when image formation is interrupted during continuous printing, the image-misregistration detection patterns illustrated in FIG. 17 are formed.

In this manner, changing the number of rows on which image-misregistration detection patterns are formed according to the printing state can save the consumption of toner.

Fourth Embodiment

Next, a color image forming apparatus according to a fourth embodiment is described.

Figure 20:
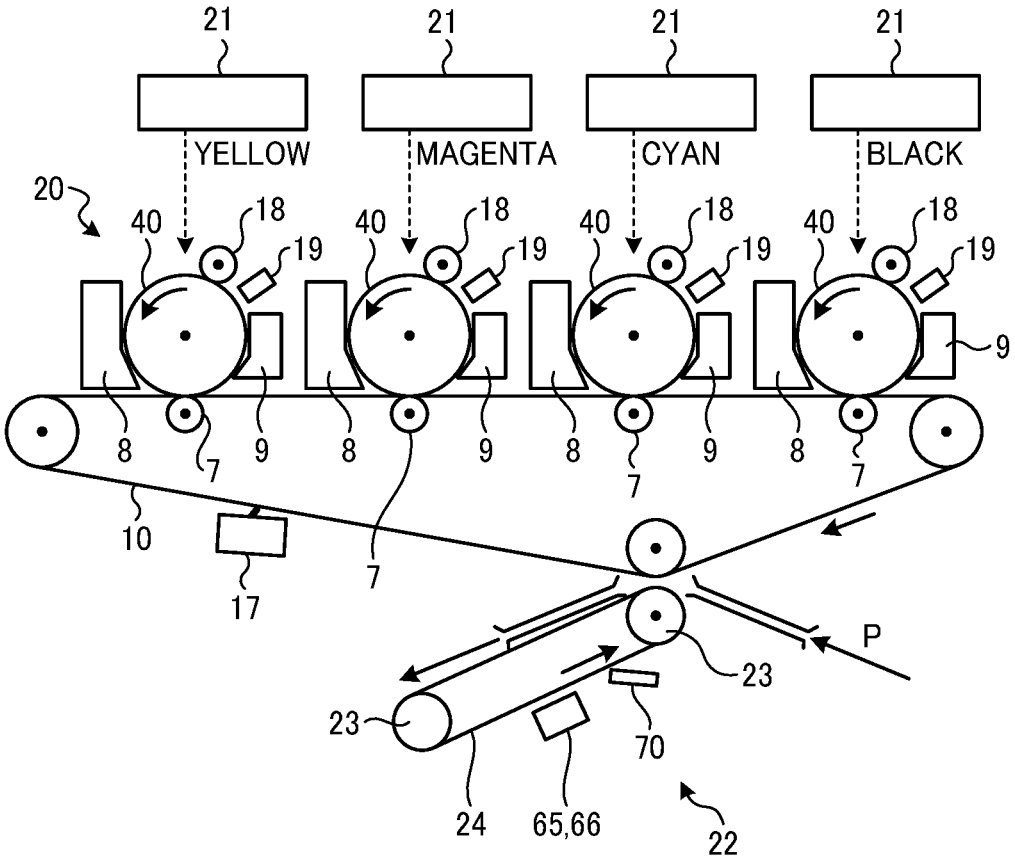
FIG. 20 is a diagram illustrating a configuration of an image forming device of a color image forming apparatus according to a fourth embodiment.

FIG. 20 is a diagram illustrating a configuration of an image forming device of the color image forming apparatus according to the fourth embodiment. In the first embodiment, the first sensor 61 and the second sensor 62 detect image-misregistration detection patterns formed on the intermediate transfer belt 10. However, in the fourth embodiment, a fourth sensor 65 and a fifth sensor 66 detect image-misregistration detection patterns formed on the secondary transfer belt 24. The same components as those of the first embodiment are denoted by the same reference numerals, and the description thereof is omitted.

The intermediate transfer belt 10 according to the fourth embodiment transfers an image-misregistration detection pattern formed on the intermediate transfer belt 10 to the secondary transfer belt 24. The fourth sensor 65 and the fifth sensor 66, which are reflective optical sensors, detect image-misregistration detection patterns formed on the secondary transfer belt. The fourth sensor 65 and the fifth sensor 66 supply detected image pattern information to the printer controller 87. As in each of the above-described embodiments, the printer controller 87 calculates a misregistration amount of an image-misregistration detection pattern (assumed to be formed on the secondary transfer belt 24 in the present embodiment), and generates correction data for correcting the misregistration. The correction data is set in the writing-start-position controller 81 and the pixel clock generator 130 and stored in the storage device 88. When an image forming operation is performed, the correction data stored in the storage device 88 is read by the printer controller 87, which is an example of a correction unit, and is set in the writing-start-position controller 81 and the pixel clock generator 130.

The printer controller 87 corrects the image misregistration in the main scanning direction and the sub-scanning direction between the respective colors and the image magnification in the main scanning direction based on the detection results of the image-misregistration detection patterns by the fourth sensor 65 and the fifth sensor 66. The printer controller 87 calculates speed variations of the photoconductor 40, the intermediate transfer belt 10, and the secondary transfer belt 24 from the pattern intervals of the image-misregistration detection patterns detected by the fourth sensor 65 and the fifth sensor 66, and displays the information on, for example, an operation panel.

The image-misregistration detection patterns having passed through the fourth sensor 65 and the fifth sensor 66 are removed by a secondary transfer belt cleaning unit 70.

Here, the description of image-misregistration detection patterns to be formed on the secondary transfer belt 24 is similar to the description of image-misregistration detection patterns to be formed on the intermediate transfer belt 10 in FIGS. 14 and 17, and thus a description of the image-misregistration detection pattern is omitted here. The configurations of FIGS. 14 and 17 may be applied to the fourth sensor 65 and the fifth sensor 66. Also in the flowcharts of FIGS. 12 and 18, the intermediate transfer belt 10 on which the image-misregistration detection pattern is formed can be replaced with the secondary transfer belt 24 for describing the image-misregistration correction process in the fourth embodiment, and thus the description thereof is omitted here. In the present embodiment, the forming unit corresponds to the pattern detection unit 112 and the intermediate transfer belt 10, and forms (transfers) the image-misregistration detection pattern on the intermediate transfer belt 10 onto the secondary transfer belt 24.

Also in the fourth embodiment, erroneous image misregistration correction can be prevented from being performed in a state in which a variation occurs in the drive system 60, thus preventing such erroneous image misregistration correction from degrading the image quality.

Finally, the above-described embodiments are presented as examples and are not intended to limit the scope of the present disclosure. The above-described aspects of the present disclosure can be embodied in other various forms, and various omissions, replacements, and changes can be made without departing from the scope of the invention. In addition, the embodiments and modifications or variations thereof are included in the scope and the gist of the invention and are included in the invention described in the claims and the equivalent scopes thereof.

The functions of the above-described embodiments may be implemented by one or a plurality of processing circuits. Here, the processing circuit or circuitry in the present specification includes a programmed processor to execute each function by software, such as a processor implemented by an electronic circuit, and devices, such as an application specific integrated circuit (ASIC), a digital signal processor (DSP), and a field programmable gate array (FPGA), and conventional circuit modules arranged to perform the recited functions.

The invention claimed is:

1. An image forming apparatus, comprising a transfer belt;

a forming unit configured to form an image-misregistration detection pattern of a plurality of colors on the transfer belt;

a detection unit configured to detect the image-misregistration detection pattern formed on the transfer belt;

a correction unit configured to correct an image misregistration of an image of each of the plurality of colors based on a detection result of the image-misregistration detection pattern by the detection unit;

a drive system configured to drive at least the transfer belt;

a determination unit configured to detect, for each of the colors, a difference amount between a pattern interval of the image-misregistration detection pattern formed on the transfer belt and a reference interval serving as a preset reference value for each color, and determine that an abnormality has occurred in a driving state of the drive system, in response to the difference amount detected for at least one of the colors being equal to or greater than a predetermined threshold value; and a notification unit configured to notify occurrence of the image misregistration when the determination unit determines that the driving state of the drive system is abnormal.

2. The image forming apparatus according to claim 1, wherein the notification unit is configured to perform notification of a color for which the determination unit determines that the abnormality has occurred in the driving state of the drive system, together with a notification of the occurrence of the image misregistration.

3. The image forming apparatus according to claim 1, wherein the notification unit is configured to perform notification of a position of the image-misregistration detection pattern at which the determination unit determines that the abnormality has occurred in the driving state of the drive system, together with a notification of the occurrence of the image misregistration.

4. The image forming apparatus according to claim 1, wherein the forming unit is configured to form image-misregistration detection patterns for at least two rows along a moving direction of the transfer belt, wherein the detection unit is configured to detect each of the image-misregistration detection patterns, and wherein the determination unit is configured to determine whether an abnormality has occurred in the driving state of the drive system based on detection outputs of the image-misregistration detection patterns detected by the detection unit, using both a pattern interval of the image-misregistration detection patterns corresponding to a main scanning direction perpendicular to the moving direction of the transfer belt and a pattern interval of the image-misregistration detection patterns corresponding to a sub-scanning direction that is the moving direction of the transfer belt.

5. The image forming apparatus according to claim 1, further comprising a plurality of detection units disposed at three positions in a direction crossing a moving direction of the transfer belt and detects the image-misregistration detection pattern.

6. The image forming apparatus according to claim 5,
wherein the forming unit is configured to form two or three rows of image-misregistration detection patterns in a direction crossing the moving direction of the transfer belt,
wherein each of the two or three rows of image-misregistration detection patterns is formed along the moving direction of the transfer belt.

7. The image forming apparatus according to claim 1, further comprising another transfer belt in contact with the transfer belt,
wherein the forming unit is configured to form the image-misregistration detection pattern on the transfer belt, transfer the image-misregistration detection pattern on the transfer belt to said another transfer belt, and the detecting unit is configured to detect the image-misregistration detection pattern on said another transfer belt.

8. The image forming apparatus according to claim 1,
wherein the notification unit is configured to make an indication corresponding to a notification of the occurrence of the image misregistration on a display.

9. The image forming apparatus according to claim 1,
wherein the notification unit is configured to cancel a notification of the occurrence of the image misregistration after an end of printing of a printed matter.

10. The image forming apparatus according to claim 9,
wherein the notification unit is configured to continue the notification after the end of printing of the printed matter, in a case where the printed matter does not include a color for which an abnormality in the driving state of the drive system is detected.

11. The image forming apparatus according to claim 1,
wherein the forming unit is configured to form the image-misregistration detection pattern by forming horizontal line patterns and oblique line patterns on the transfer belt for each of the colors.

12. The image forming apparatus according to claim 11,
wherein the horizontal line patterns and the oblique line patterns alternate in a moving direction of the transfer belt.

13. The image forming apparatus according to claim 12,
wherein the forming unit is configured to form the horizontal line patterns and the oblique line patterns by:
forming a horizontal line for each of the colors in each of the horizontal line patterns; and
forming an oblique line for each of the colors in each of the oblique line patterns.

14. The image forming apparatus according to claim 11,
wherein the detection unit is configured to sequentially detect a horizontal line pattern and an oblique line pattern when the transfer belt moves in a moving direction.

15. An image forming method, comprising:
forming an image-misregistration detection pattern of a plurality of colors on a transfer belt;
detecting the image-misregistration detection pattern formed on the transfer belt;
correcting an image misregistration of an image of each of the plurality of colors based on a detection result of the image-misregistration detection pattern;
detecting, for each of the colors, a difference amount between a pattern interval of the image-misregistration detection pattern formed on the transfer belt and a reference interval serving as a preset reference value for each color;
determining that an abnormality has occurred in a driving state of a drive system that drives at least the transfer belt, in response to the difference amount detected for at least one of the colors being equal to or greater than a predetermined threshold value; and
notifying occurrence of the image misregistration in response to a determination that the driving state of the drive system is abnormal.

16. The image forming method according to claim 15,
wherein forming the image-misregistration detection pattern comprises forming horizontal line patterns and oblique line patterns on the transfer belt for each of the colors.

17. The image forming method according to claim 16,
wherein the horizontal line patterns and the oblique line patterns alternate in a moving direction of the transfer belt.

18. The image forming method according to claim 17,
wherein forming the horizontal line patterns and the oblique line patterns comprises:
forming a horizontal line for each of the colors in each of the horizontal line patterns; and
forming an oblique line for each of the colors in each of the oblique line patterns.

19. The image forming method according to claim 16,
wherein detecting the image-misregistration detection pattern formed on the transfer belt comprises sequentially detecting a horizontal line pattern and an oblique line pattern when the transfer belt moves in a moving direction.

20. The image forming method according to claim 16,
wherein detecting, for each of the colors, the difference amount between the pattern interval of the image-misregistration detection pattern and the reference interval serving as the reference value comprises:
detecting, for each of the colors, the pattern interval between successive horizontal line patterns of a same color in a moving direction of the transfer belt; and
calculating, for each of the colors, a difference between the pattern interval and the reference interval, wherein a calculation result comprises the difference amount for a color.

* * * * *